US012129608B2

(12) United States Patent
Aziz et al.

(10) Patent No.: US 12,129,608 B2
(45) Date of Patent: Oct. 29, 2024

(54) OVERLAPPING MODULAR MAT SYSTEMS

(71) Applicant: Newpark Mats & Integrated Services LLC, The Woodlands, TX (US)

(72) Inventors: Saad Aziz, Carencro, LA (US); Gaurav Agrawal, Katy, TX (US)

(73) Assignee: NEWPARK MATS & INTEGRATED SERVICES LLC, The Woodlands, TX (US)

( * ) Notice: Subject to any disclaimer, the term of this patent is extended or adjusted under 35 U.S.C. 154(b) by 392 days.

(21) Appl. No.: 16/890,510

(22) Filed: Jun. 2, 2020

(65) Prior Publication Data

US 2021/0372056 A1 Dec. 2, 2021

(51) Int. Cl.
*E01C 9/08* (2006.01)
*E01C 11/16* (2006.01)
*E01C 5/20* (2006.01)

(52) U.S. Cl.
CPC ..... *E01C 9/086* (2013.01); *E01C 9/08* (2013.01); *E01C 11/16* (2013.01); *E01C 5/20* (2013.01)

(58) Field of Classification Search
CPC . E01C 9/08; E01C 9/086; E01C 11/16; E01C 11/165
See application file for complete search history.

(56) References Cited

U.S. PATENT DOCUMENTS 284,268 A * 9/1883 Berliner ..... E04F 15/02 428/44
526,457 A * 9/1894 Neale ..... E04D 9/00 52/750
2,274,468 A * 2/1942 Bell ..... A47G 27/0212 112/440
4,596,729 A * 6/1986 Morrison ..... E04F 15/02188 52/180
6,511,257 B1 * 1/2003 Seaux ..... E01C 9/086
(Continued)

FOREIGN PATENT DOCUMENTS

KR 20040010413 A 1/2004
RU 100794 U1 12/2010
(Continued)

OTHER PUBLICATIONS

International Search Report, International Application No. PCT/US2021/033126, Date of Mailing Aug. 26, 2021, Russian Federal Institute of Industrial Property; International Search Report 3 pages.
(Continued)

*Primary Examiner* — Thomas B Will
*Assistant Examiner* — Katherine J Chu
(74) *Attorney, Agent, or Firm* — CANTOR COLBURN LLP

(57) ABSTRACT

Mats and methods associated therewith are described. The mats include a main body defined by a plurality of sidewalls and two exterior surface walls opposing each other. The main body includes a pattern of internal walls that define internal voids within the main body. At least one primary structural support rib is arranged within the main body and extends between the two surface walls and from one of the plurality of side walls to another of the plurality of side walls. The at least one primary structural support rib traverses the internal voids defined by the pattern of internal walls.

20 Claims, 18 Drawing Sheets

(56) References Cited

U.S. PATENT DOCUMENTS

| | | | | |
|---|---|---|---|---|
| 7,048,469 | B1 * | 5/2006 | Jansson | E01C 9/086 405/20 |
| 7,303,800 | B2 * | 12/2007 | Rogers | B32B 3/02 428/44 |
| 7,607,265 | B2 * | 10/2009 | Curry | A63C 19/12 52/180 |
| 8,414,217 | B2 * | 4/2013 | Rosan | E01C 5/22 404/35 |
| 8,784,001 | B1 * | 7/2014 | Phillips | E21B 41/0021 404/46 |
| 8,881,482 | B2 * | 11/2014 | Cerny | E01C 13/045 52/126.5 |
| 8,936,374 | B1 * | 1/2015 | Royse | E01C 9/086 404/35 |
| 9,010,060 | B2 * | 4/2015 | Rapaz | E01C 5/223 52/592.1 |
| D832,468 | S * | 10/2018 | Jones | D25/163 |
| 10,196,826 | B1 * | 2/2019 | Rosan | E04H 3/28 |
| 10,288,100 | B2 * | 5/2019 | Osborne | B64D 11/0696 |
| 2008/0127593 | A1 * | 6/2008 | Janesky | E04F 15/18 52/591.1 |
| 2011/0023389 | A1 * | 2/2011 | Myers | E04F 15/105 52/173.1 |
| 2015/0376904 | A1 * | 12/2015 | Huss | E04F 15/02038 52/745.13 |
| 2019/0119862 | A1 * | 4/2019 | Penland, Jr. | E01C 5/18 |
| 2023/0249413 | A1 * | 8/2023 | Amrine | B29C 69/001 264/157 |

FOREIGN PATENT DOCUMENTS

| | | | | |
|---|---|---|---|---|
| RU | 187181 | U1 | 2/2019 | |
| WO | 9936638 | A1 | 7/1999 | |
| WO | WO-0192638 | A1 * | 12/2001 | E01C 9/086 |
| WO | 2008045447 | A2 | 4/2008 | |
| WO | 2008138116 | A1 | 11/2008 | |
| WO | 2017070311 | A1 | 4/2017 | |

OTHER PUBLICATIONS

International Written Opinion, International Application No. PCT/US2021/033126, Date of Mailing Aug. 26, 2021, Russian Federal Institute of Industrial Property; International Written Opinion 4 pages.

European Search Report for European Application No. 21818544.5; Date of Action: May 15, 2024; 7 pages.

* cited by examiner

OVERLAPPING MODULAR MAT SYSTEMS

BACKGROUND

When performing operations with heavy equipment it may be useful to provide a firm, stable, and continuous support surface to support such heavy equipment or otherwise provide for a stable work surface and/or a support surface over which vehicles may be conveyed. Such support surfaces can provide support for the equipment, vehicles, and personnel involved in work processes and may be configured to withstand severe weather and other harsh environmental impacts. The components of the support surface may be capable of being quickly and easily installed and capable of being easily removed and reused.

Wooden boards or planks have historically been used to construct temporary roadways and equipment support surfaces in remote or undeveloped areas where the terrain lacks sufficient integrity to adequately support trucks and other heavy equipment. Such boards were generally placed end to end, or side by side, to form a continuous load supporting surface. While individual wooden boards or planks have been used to construct support surfaces for some time, this method of building roadways and other load bearing surfaces suffers from some very significant disadvantages.

A variety of mat systems have been developed for the construction of temporary roadways and support surfaces. These mat systems typically utilize prefabricated, multi-layered mats which can be installed in a variety of configurations to create roadways or other support surfaces. These mats, which are constructed of a number of individual boards or planks affixed together in a variety of configurations, generally interconnect or inter mesh with one another to form a continuous, or nearly continuous, support surface. It may be advantageous to have improved mats and systems for providing and creating temporary roadways and/or support surfaces.

SUMMARY

According to some embodiments, mats are provided and described. The mats include a main body defined by a plurality of sidewalls and two exterior surface walls opposing each other. The main body includes a pattern of internal walls that define internal voids within the main body. At least one primary structural support rib is arranged within the main body and extends between the two surface walls and from one of the plurality of side walls to another of the plurality of side walls. The at least one primary structural support rib traverses the internal voids defined by the pattern of internal walls.

In addition to one or more of the features described above, or as an alternative, embodiments of the mats may include that the at least one primary structural support rib divides the main body into at least two sections.

In addition to one or more of the features described above, or as an alternative, embodiments of the mats may include at least one secondary structural support rib that is arranged within one of the at least two sections defined by the at least one primary structural support rib, wherein the at least one secondary structural support rib traverses the internal voids defined by the pattern of internal walls.

In addition to one or more of the features described above, or as an alternative, embodiments of the mats may include that the at least one secondary structural support rib that divides the respective section into two or more subsections.

In addition to one or more of the features described above, or as an alternative, embodiments of the mats may include at least one secondary structural support rib that extends from at least one of the side walls to at least one of the at least one primary structurally support rib.

In addition to one or more of the features described above, or as an alternative, embodiments of the mats may include at least one secondary structural support rib having a length that is less than a length of the at least one primary structural support rib.

In addition to one or more of the features described above, or as an alternative, embodiments of the mats may include at least one secondary structural support rib having a material thickness that is less than a material thickness of the at least one primary structural support rib.

In addition to one or more of the features described above, or as an alternative, embodiments of the mats may include that the at least one primary structural support rib is configured to enable separation of the mat into a plurality of sub-mats.

In addition to one or more of the features described above, or as an alternative, embodiments of the mats may include that each sub-mat is configured to secure or connect to another one of the plurality of the sub-mats or another mat.

In addition to one or more of the features described above, or as an alternative, embodiments of the mats may include a hook pocket defined along the at least one primary structural support rib, the hook pocket configured to enable a tool to engage with a sub-mat.

In addition to one or more of the features described above, or as an alternative, embodiments of the mats may include a lip structure extending outwardly from the plurality of sidewalls around a periphery of the main body.

In addition to one or more of the features described above, or as an alternative, embodiments of the mats may include that the at least one primary structural support rib is configured to enable separation of the mat into a plurality of sub-mats and wherein each sub-mat includes a portion of the lip structure.

In addition to one or more of the features described above, or as an alternative, embodiments of the mats may include that the internal voids of the interior support structure define at least 45% of an interior volume of the main body.

According to some embodiments, methods are described. The methods include cutting a mat to form a first sub-mat and a second sub-mat. The mat includes a main body defined by a plurality of sidewalls and two exterior surface walls. The main body includes a first primary structural support rib arranged within the main body and extending between the two surface walls and from one of the plurality of side walls to another of the plurality of side walls. The first primary structural support rib divides the mat into two sections, wherein the two sections form the first sub-mat and the second sub-mat.

In addition to one or more of the features described above, or as an alternative, embodiments of the methods may include securing the first sub-mat to the second sub-mat to form a support surface.

In addition to one or more of the features described above, or as an alternative, embodiments of the methods may include that the mat comprises a second primary structural support rib that extends in a direction generally perpendicular to the first primary structural support rib, and the first primary structural support rib and the second primary structural support rib define four sections configured to be divided into four sub-mats.

In addition to one or more of the features described above, or as an alternative, embodiments of the methods may include cutting the mat along the first primary structural support rib and the second primary structural support rib to form a first sub-mat, a second sub-mat, a third sub-mat, and a fourth sub-mat.

In addition to one or more of the features described above, or as an alternative, embodiments of the methods may include connecting at least one of the first sub-mat, the second sub-mat, the third sub-mat, and the fourth sub-mat to one or more full mats to form a support surface.

In addition to one or more of the features described above, or as an alternative, embodiments of the methods may include joining at least one of the first sub-mat and the second sub-mat with a full mat to form a support surface.

In addition to one or more of the features described above, or as an alternative, embodiments of the methods may include that the cutting is along the first primary structural support rib such that the first sub-mat and the second sub-mat each have a portion of the first primary structural support rib after being cut and separated from one another.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure, are apparent from the following detailed description taken in conjunction with the accompanying drawings in which like elements may be numbered alike and:

DETAILED DESCRIPTION

Characteristics and advantages of the present disclosure and additional features and benefits will be readily apparent to those skilled in the art upon consideration of the following detailed description and accompanying figures. It should be understood that the description herein and associated drawings, being of example embodiments, are not intended to limit the claims of this patent or any patent or patent application claiming priority hereto. On the contrary, the intention is to cover all modifications, equivalents, and/or alternatives as appreciated by those of skill in the art. Many changes may be made to the particular embodiments and details disclosed herein without departing from the scope of the present disclosure.

Figure 1A:
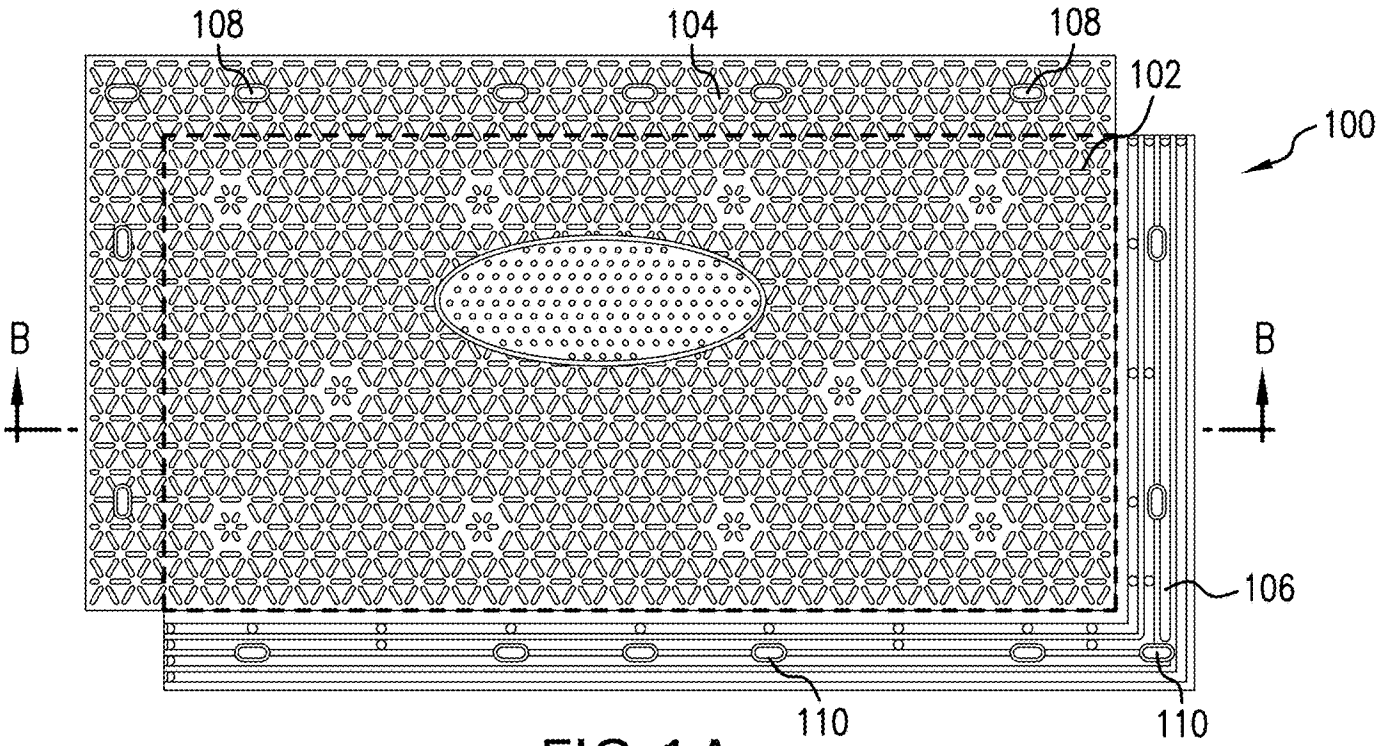
FIG. 1A is a schematic illustration of a mat that may incorporate embodiments of the present disclosure.
Figure 1B:
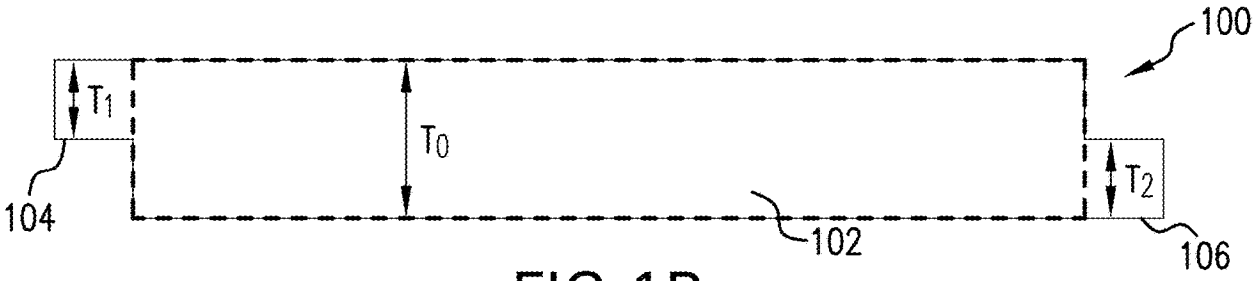
FIG. 1B is a cross-sectional illustration of the mat of FIG. 1A as viewed along the line B-B of FIG. 1A.

Referring to FIGS. 1A-1B, schematic illustrations of a mat 100 that may incorporate embodiments of the present disclosure are shown. The mat 100 is configured to be a stand-alone structure or may be joined with one or more additional similar mats to define a support surface of a desired shape and/or size. The mat 100 is configured to provide a work or support surface over which vehicles may traverse, equipment may be installed and operated, etc. FIG. 1A illustrates a top-down plan view illustration of the mat 100 and FIG. 1B is a cross-sectional illustration of the mat 100 as viewed along the line B-B in FIG. 1A. The mat 100 includes a main body 102, a first lip structure 104, and a second lip structure 106. As shown, the main body 102 has a main body thickness $T_0$, and each lip structure 104, 106 has a respective lip structure thickness $T_1$, $T_2$. Because the mat 100 is configured to be joinable with other similar mats, the lip structure thicknesses $T_1$, $T_2$ can each be, for example, equal to half the main body thickness $T_0$. In some configurations, the lip structure thicknesses $T_1$, $T_2$ can each be, for example, substantially equal to the main body thickness $T_0$.

The lip structures 104, 106 each extend outward from the main body 102. In one or more embodiments, each of the lip structures 104, 106 may extend from about half of a perimeter of the main body 102. The lip structures 104, 106 each include, as shown, respective pin apertures 108, 110 that are configured to receive a locking pin (not shown) to join two mats that are arranged adjacent to each other with pin apertures aligned. Such locking pins can be used to ensure a secure and continuous surface defined by the joined mats.

That is, when two mats similar to that shown in FIGS. 1A-1B are joined by one or more locking pins installed through aligned pin apertures 108, 110, a first lip structure 104 on one mat 100 may overlap a second lip structure 106 of the adjacent mat, with the joined first and second lip structures of the two mats having a thickness equal to the main body thickness $T_0$.

Although shown and described as distinct components or features, the main body 102, the first lip structure 104, and the second lip structure 106 may be formed of a single continuous material (e.g., a uniform body), from two panels or portions joined together, or from three or more joined panels of portions. As a non-limiting example, the lip structures 104, 106 can be separately attached to, bonded to, or otherwise secured to the main body 102. As another example, the main body 102 can be formed from two panels, each having one of the lip structures 104, 106, and the two panels can be attached, bonded, or otherwise secured together. Accordingly, the illustrative configuration shown and described with respect to FIGS. 1A-1B is not intended to be limiting, but rather is provided for illustrative and explanatory purposes only.

Figure 2:
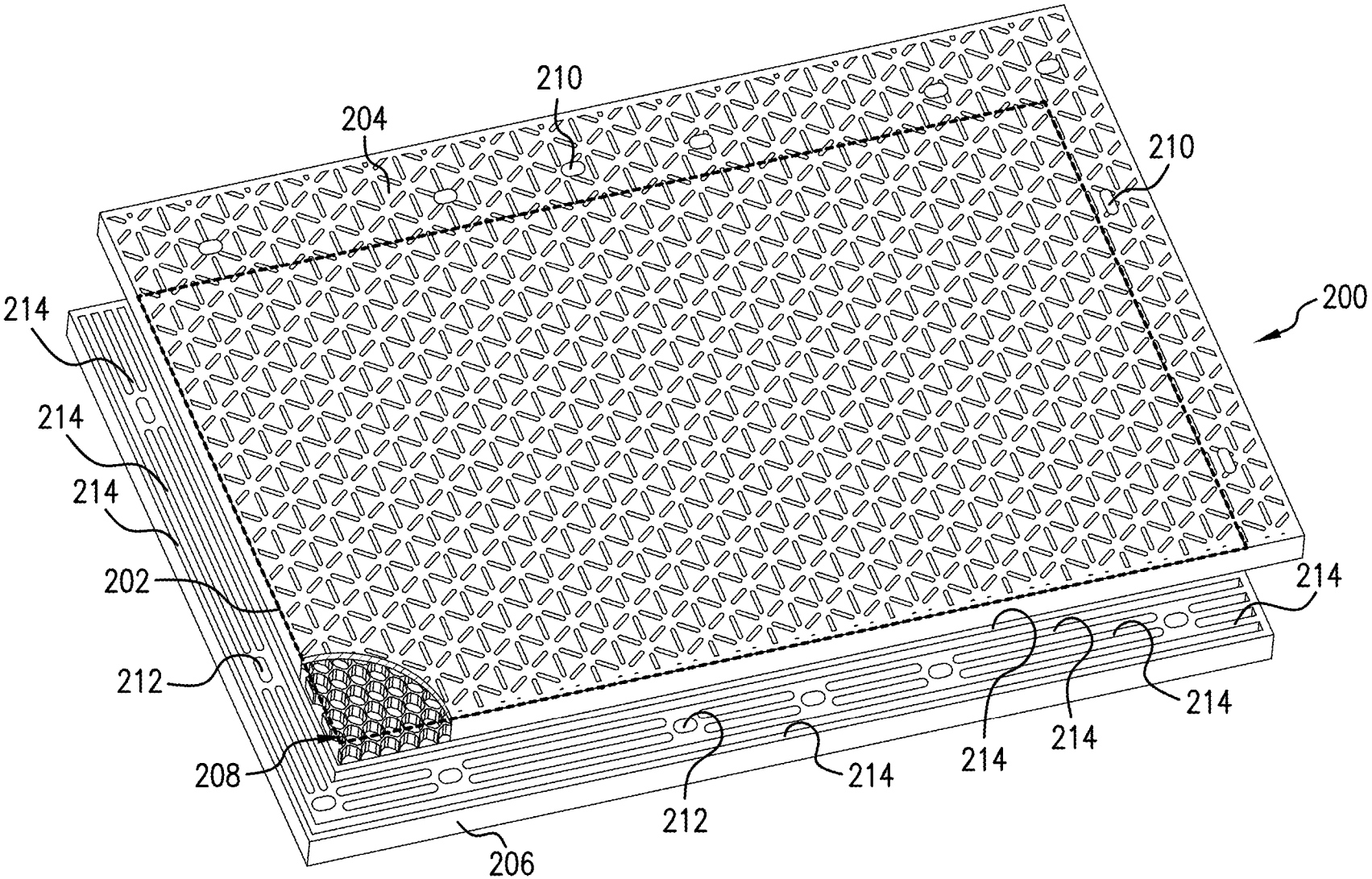
FIG. 2 an isometric illustration of a mat that may incorporate embodiments of the present disclosure, with a partial cutaway illustrating an interior structure of the mat.

Turning now to FIG. 2, a schematic illustration of a mat 200 that may incorporate embodiments of the present disclosure is shown. The mat 200 may have a similar construction as that shown and described with respect to the mat 100 in FIGS. 1A-1B. For example, the mat 200 may be made from a rigid material capable of withstanding compression forces, such as weights or other loads, positioned on the mat 200. For example, the mat 200 may be constructed of a thermoplastic polymeric material, such as polyethylene or alkathene. In one or more embodiments, the mat 200 can be made of high-density polyethylene, medium-density polyethylene, low-density polyethylene, or mixtures thereof.

The mat 200 includes a main body 202, a first lip structure 204, and a second lip structure 206, with the first and second lip structures 204, 206 extending from the main body 202 as illustrated above. As described above, the first and second lip structures 204, 206 extend or cantilever from portions of the exterior surfaces of the main body 202. The lip structures 204, 206 each include respective pin apertures 210, 212 to enable connection to and joining of two adjacent mats. The lip structures 204, 206 may also include respective rib structures 214 (only shown for the second lip structure 206 in this illustration) which may be aligned (e.g., top to bottom) or misaligned with a similar ribbed structure of an adjacent mat when two mats are arranged adjacent to each other and connected by locking pins.

The main body 202 includes an interior support structure 208. The interior support structure 208 is configured to provide strength to the mat 200, such as crush strength. The interior support structure 208 may be a combination of voids and ribs that are encapsulated by exterior surfaces of the main body 202. Thus, the interior support structure 208 can permit a reduction in weight as compared to a solid body structured mat.

The interior support structure 208 of the main body 202, may be, in some configurations, an interconnected web structure such as in a honeycomb or other geometric pattern, which may be a repeating pattern of the same geometric shape. As noted, the interior support structure 208 defines voids within the main body 202.

For example, in one non-limiting example, the voids of the interior support structure 208 may define at least 30% of the interior volume of the main body 202 (i.e., the main body 202 is 30% internally hollow in this example). The size and shape of the repeating pattern of the interconnected web structure can be changed or modified to change the amount of voids in the main body 202. For example, the voids may define at least 45%, at least 50%, at least 60%, at least 70%, and/or other amount of the interior volume of the mat 200 that will be appreciated by those having ordinary skill in the art, depending on the application and use of the mat 200. In configurations where the interior support structure 208 is a geometric repeating pattern, each void of the interior support structure 208 may be between and inclusive of about 2.5 inches (6.35-cm) and about 5 inches (12.7-cm) in the largest dimension thereof.

Figure 3:
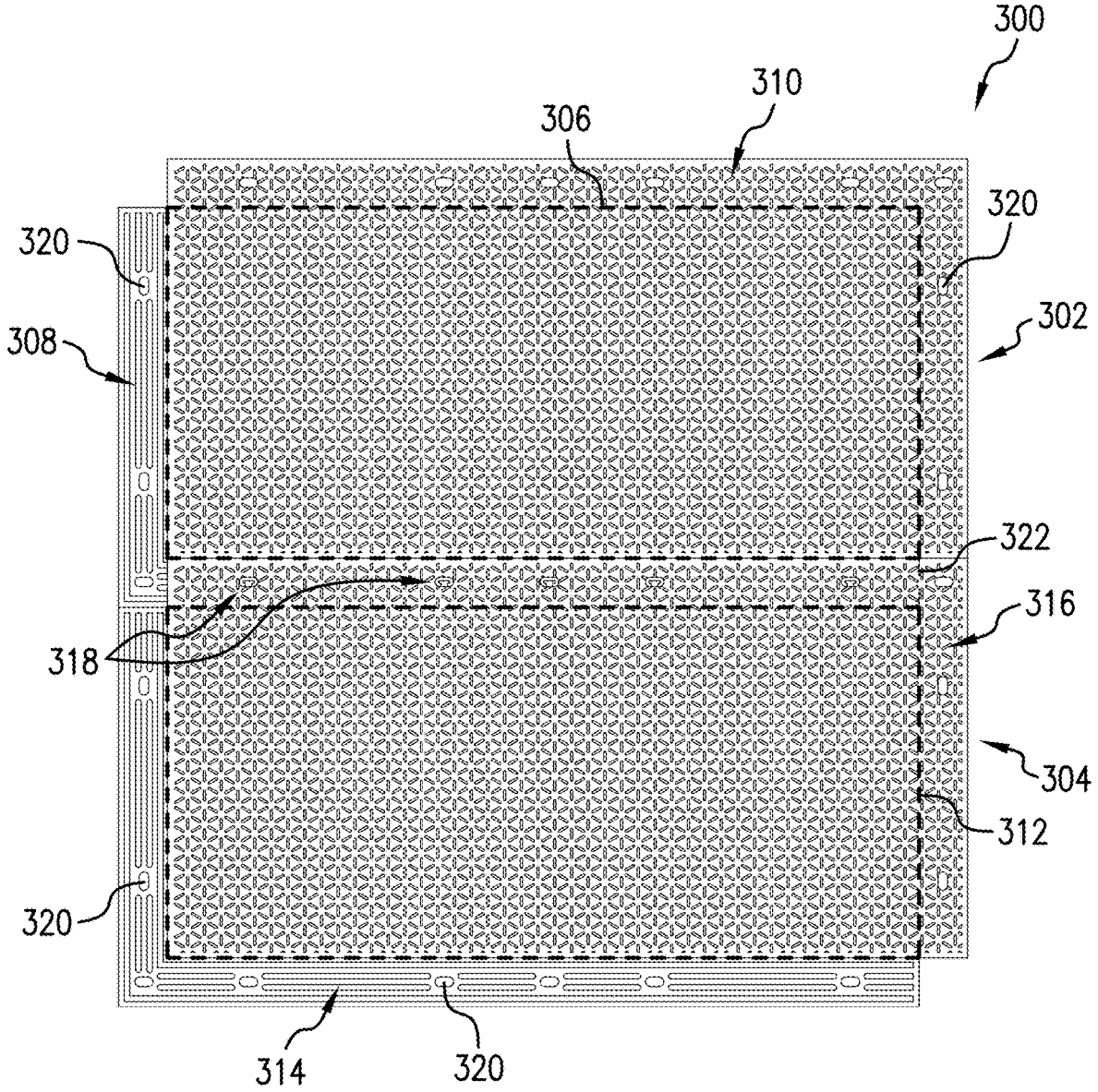
FIG. 3 is a schematic illustration of a mat assembly of two joined mats that may incorporate embodiments of the present disclosure.

Turning now to FIG. 3, a schematic illustration of a mat assembly 300 that can incorporate embodiments of the present disclosure is shown. The mat assembly 300 includes, in this illustration, two joined mats 302, 304. The mat assembly 300 is a modular mat system which incorporates the mats as shown and described above. A first mat 302 of the mat assembly 300 has a respective main body 306 with lip structures 308, 310 extending therefrom. A second mat 304 of the mat assembly 300 has a respective main body 312 with lip structures 314, 316 extending therefrom. The two mats 302, 304 are joined at overlapping lip structures 308, 316. Locking pins 318 are inserted through aligned pin apertures 320 of the two overlapping lip structures 308, 316. As such, a joined and overlapping portion 322 is defined by a portion of the first mat 302 and a portion of the second mat 304. The overlapping portion 322 has the same total thickness as each of the main body 306 of the first mat 302 and the main body 312 of the second mat 304. Each of the main bodies 306, 312 may have an interior support structure that includes voids and ribs that define the voids, in order to provide strength and rigidity while enabling a relatively light-weight total structure.

FIG. 3 is illustrative of the modular nature of the mats of the present disclosure. Multiple mats may be arranged together to define a continuous and connected support surface. Such support surface may be used to provide a firm and secure surface or ground upon which vehicles may be conveyed, equipment employed, etc. Although FIG. 3 illustrates only two mats arranged adjacent to each other, those of skill in the art will appreciate that any number of interlocking and arranged mats may be provided to form a desired support surface having a geometry based on the arrangement of the mats.

Figure 4A:
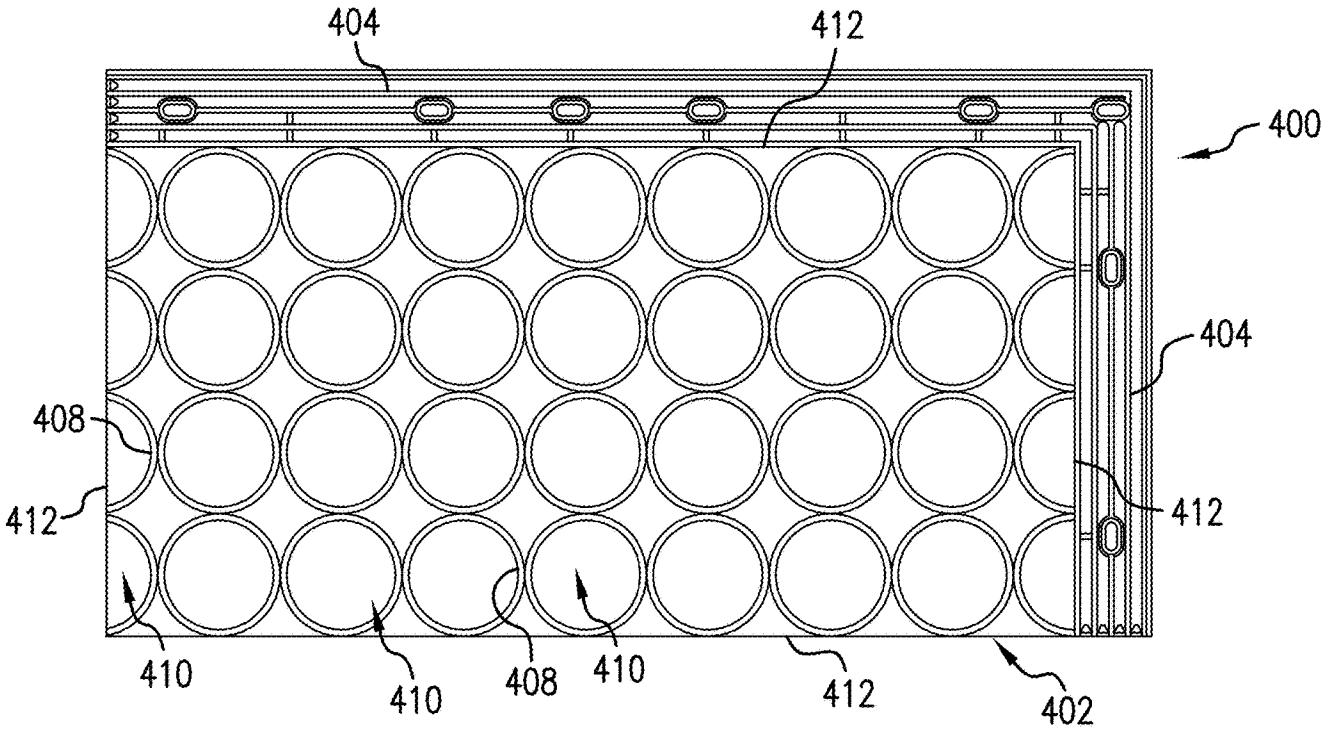
FIG. 4A is a top-down, partial cut away illustration of a mat that may incorporate embodiments of the present disclosure.
Figure 4B:
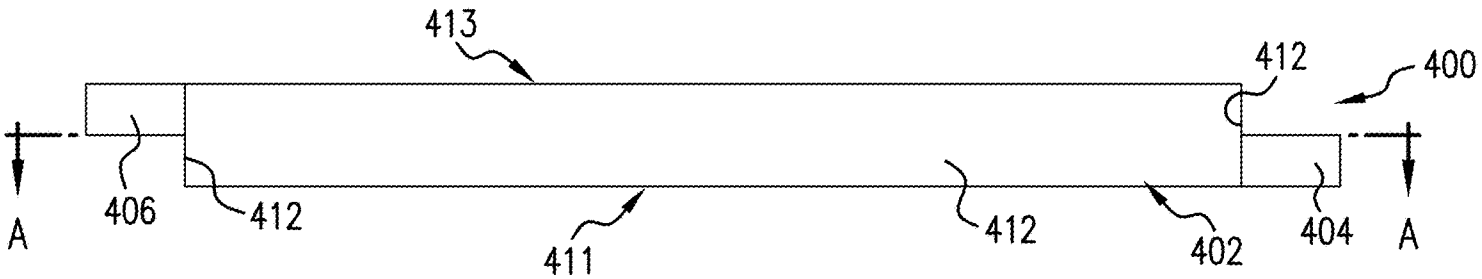
FIG. 4B is a side elevation view of the mat of FIG. 4A illustrating the view line A-A for the illustration of FIG. 4A.

Turning now to FIGS. 4A and 4B, schematic illustrations of a mat 400 are shown. FIG. 4A is a partial cut-away illustrating the interior structure of the mat 400 as viewed along the line A-A of FIG. 4B, which is a side elevation view of the mat 400. In this configuration and illustration, the mat 400 has a main body 402, a first lip structure 404, and a second lip structure 406. The main body 402 defines a partially hollow interior that includes a pattern of internal walls 408 and internal voids 410. The pattern of internal walls 408, in this illustrative configuration is a geometric pattern substantially in a hexagon, an octagon, a decagon, circular shape or other shape or pattern. The internal voids 410 can correspond in shape to the geometric pattern and can be polygonal or circular. The pattern of internal walls 408 are arranged within an interior of the main body 402. The interior of the main body 402 is bounded by sidewalls 410 and exterior surface walls 411, 413. The pattern of internal walls 408 may be formed of ribs, walls, fins, or similar structures that define the internal voids 410 and extend between a first surface wall 411 to a second surface wall 413. The pattern defined by the pattern of internal walls 408 is contained within the sidewalls 410 of the main body 402.

Figure 5:
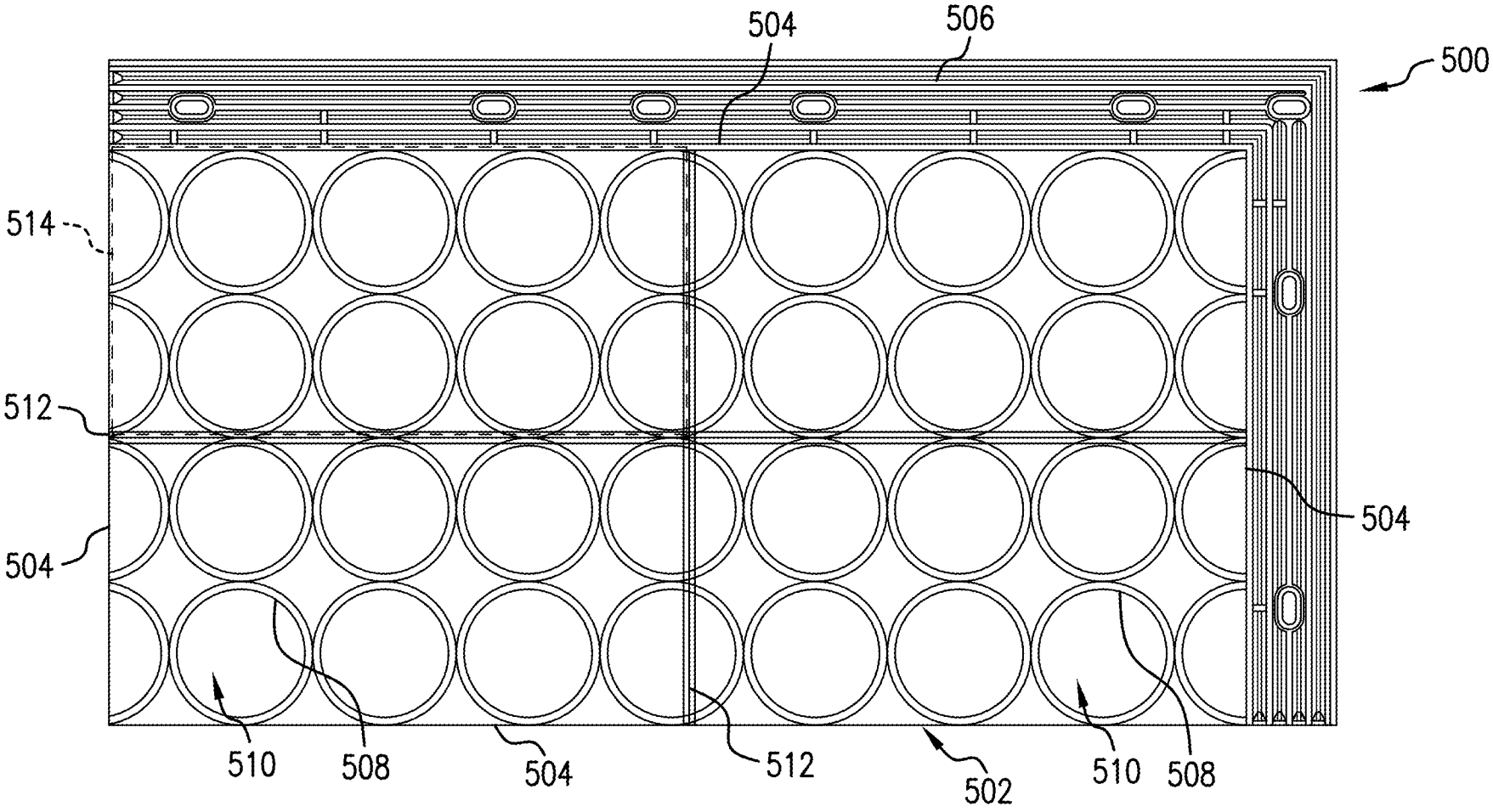
FIG. 5 is a schematic illustration of a mat in accordance with an embodiment of the present disclosure.

Turning now to FIG. 5, a mat 500 in accordance with an embodiment of the present disclosure is shown. The mat 500 may be similar to that shown and described above, having a main body 502 defined by sidewalls 504 and surface walls (not shown in this view). In this view (similar to FIG. 4A), a lip structure 506 extends outward from the sidewalls 504 along a perimeter or periphery thereof. Within the main body 502 is a pattern of internal walls 508 that defines internal voids 510.

As shown, the mat 500 further includes primary structural support ribs 512 that traverse the pattern of internal walls 508 and extend through the internal voids 510 defined by the pattern of internal walls 508. The primary structural support ribs 512 define sections 514 of the main body 502, which are defined between portions of the primary structural support ribs 512 and the sidewalls 504 of the main body 502. Each section 514 contains a part of the pattern of internal walls 508 and associated internal voids 510. It is noted that a portion or number of the internal voids 510 defined by the pattern of internal walls 508 are bisected or divided by the primary structural support ribs 512. As a result, the primary structural support ribs 512 define, in part, internal sidewalls that define the sections 514 bounded by the primary structural support ribs 512 and the sidewalls 504 of the main body 502.

In some embodiments, and as illustrated, the geometric shape of the sections 514, defined by the primary structural support ribs 512 and the sidewalls 504, have a different geometric shape than the internal voids 510 defined by the pattern of internal walls 508. Further, in some non-limiting embodiments, the primary structural support ribs 512 are configured to traverse the main body 502 from one sidewall 504 to another sidewall 504 (as shown in FIG. 5, extending between opposing or opposite sidewalls 504). For example, the primary structural support ribs 512 can extend continuously from one sidewall 504 to the other sidewall 504. The primary structural support ribs 512 are configured to increase a strength or durability of the mat 500 as compared to a mat without such primary structural support ribs 512. For example, the primary structural support ribs 512 may increase a bend resistance and increase a crush load as compared to mats having identical structure, but without the primary structural support ribs 512.

The primary structural support ribs 512 may be sized having different thickness or dimensions than the thickness or dimensions of the structure and material of the pattern of internal walls 508. For example, the primary structural support ribs 512 may have a material thickness greater than the material thickness of the pattern of internal walls 508.

Figure 6:
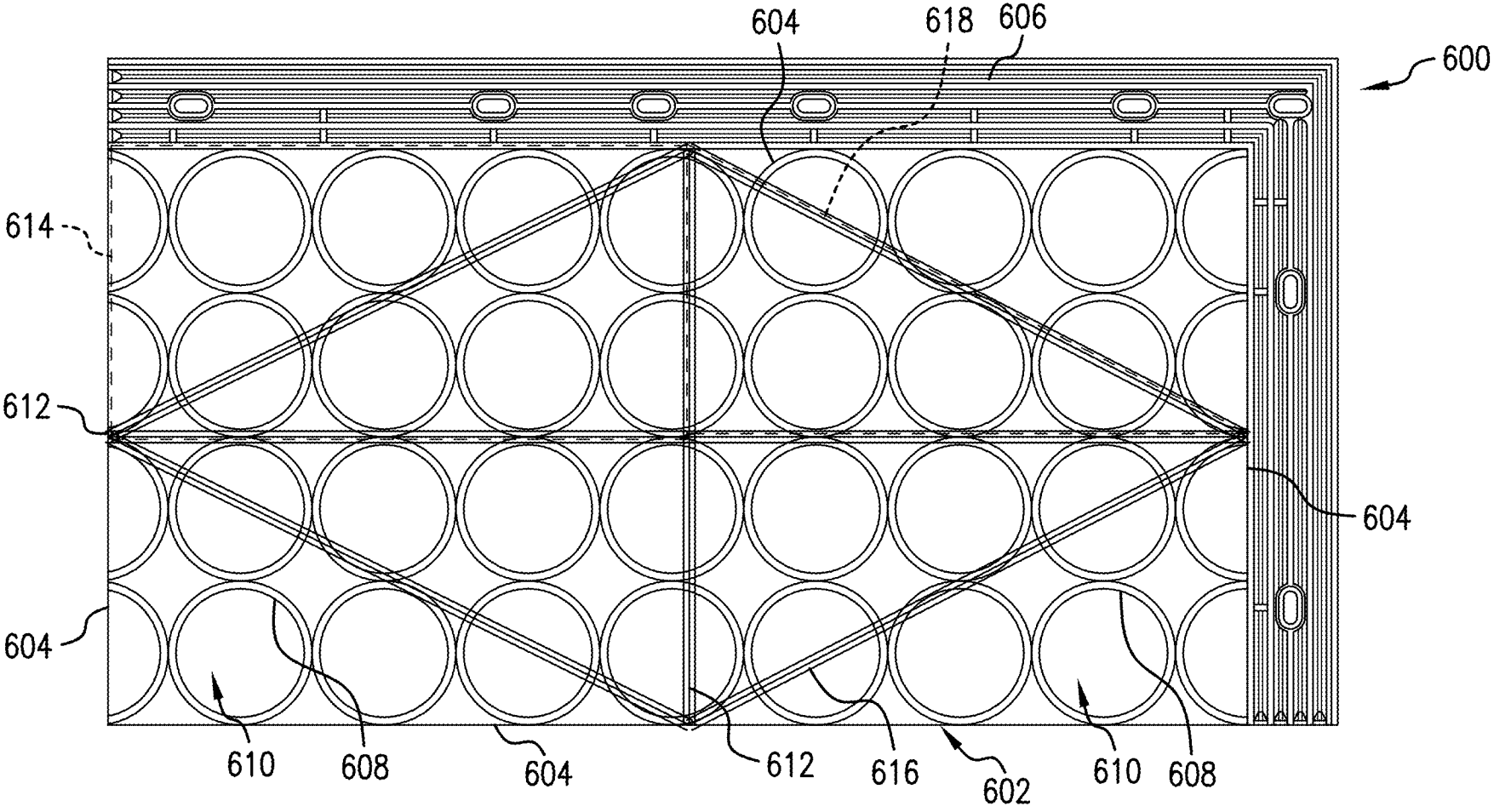
FIG. 6 is a schematic illustration of a mat in accordance with an embodiment of the present disclosure.

Turning now to FIG. 6, a mat 600 in accordance with an embodiment of the present disclosure is shown. The mat 600 may be similar to that shown and described above, having a main body 602 defined by sidewalls 604 and surface walls (not shown in this view). In this view (similar to FIG. 4A), a lip structure 606 extends outward from the sidewalls 604 along a perimeter thereof. Within the main body 602 is a pattern of internal walls 608 that defines internal voids 610. The mat 600 includes primary structural support ribs 612, similar to that shown in FIG. 5, which define sections 614.

As shown, the mat 600 includes secondary structural support ribs 616. The secondary structural support ribs 616 define subsections 618 that divide the sections 614 of the primary structural support ribs 612 into smaller sections of the main body 602. The secondary structural support ribs 616, as shown in the embodiment of FIG. 6, traverse the sections 614 and the internal voids 610 of the pattern of internal walls 608. In this illustrative embodiment, the main body 602 is rectangular in shape, the primary structural support ribs 612 are arranged to divide the rectangular shaped main body 602 into rectangular sections 614, and the secondary structural support ribs 616 are arranged to divide the rectangular sections 614 into triangular subsections 618, with the pattern of internal walls 608 and internal voids 610 having a generally honeycomb or circular shape.

In some embodiments, the primary structural support ribs 612 and the secondary structural support ribs 618 may be substantially similar in material shape or dimension (e.g., material thickness). In other embodiments, the primary structural support ribs 612 and the secondary structural support ribs 618 may have different material dimensions. For example, in some embodiments, the primary structural support ribs 612 may have a larger material thickness than the secondary structural support ribs 618. Alternatively, in some embodiments, the primary structural support ribs 612 may have a smaller material thickness than the secondary structural support ribs 618.

Figure 7:
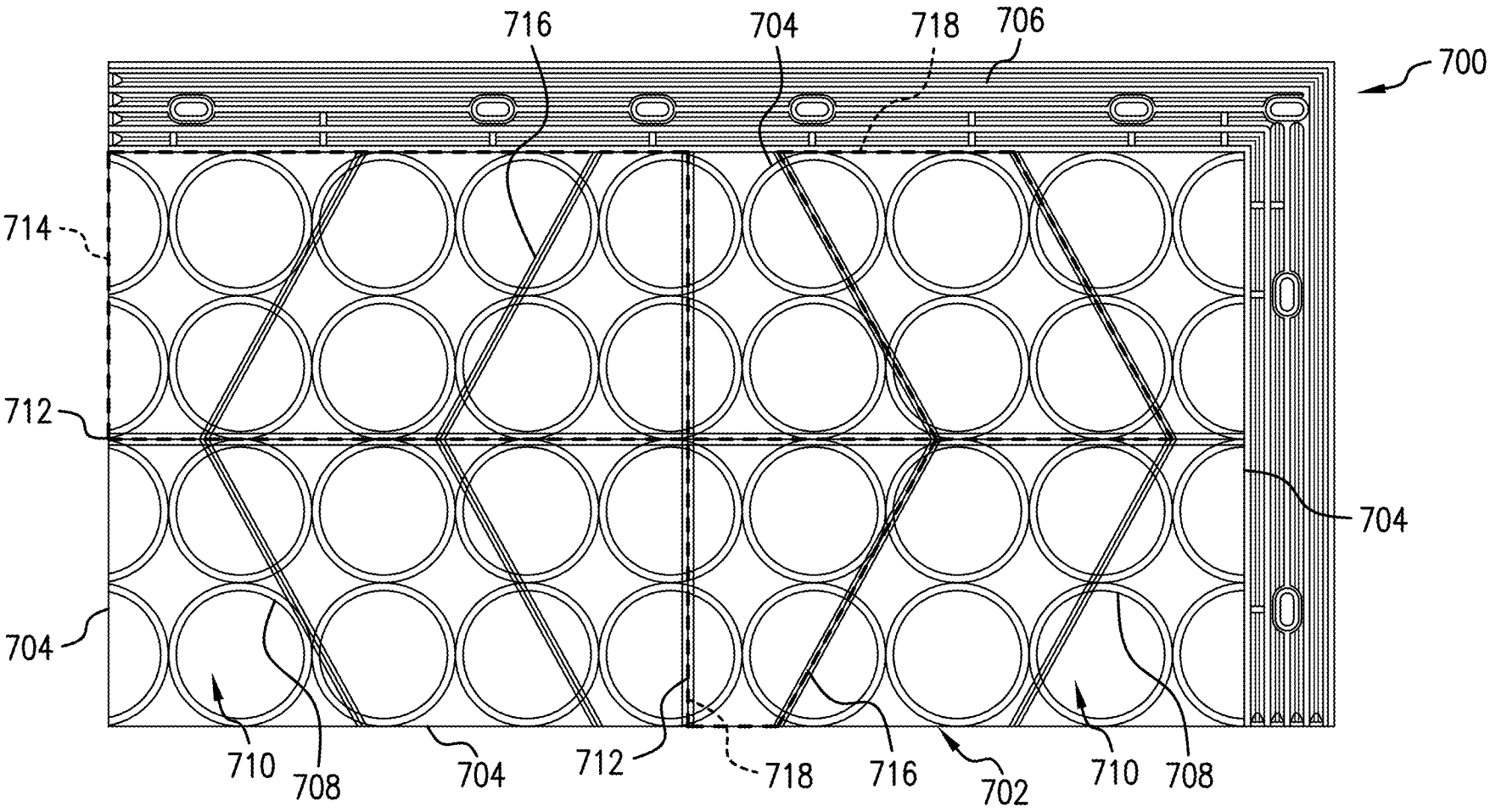
FIG. 7 is a schematic illustration of a mat in accordance with an embodiment of the present disclosure.

Turning now to FIG. 7, a mat 700 in accordance with an embodiment of the present disclosure is shown. The mat 700 may be similar to that shown and described above, having a main body 702 defined by sidewalls 704 and surface walls (not shown in this view). In this view (similar to FIG. 4A), a lip structure 706 extends outward from the sidewalls 704 along a perimeter thereof. Within the main body 702 is a pattern of internal walls 708 that defines internal voids 710. The mat 700 includes primary structural support ribs 712 that define sections 714 and secondary structural support ribs 716 define subsections 718 that divide the sections 714 of the primary structural support ribs 712 into smaller sections of the main body 702. In this configuration, each of the subsections 718 are not uniform or similar in shape (e.g., as shown in FIG. 6).

Figure 8:
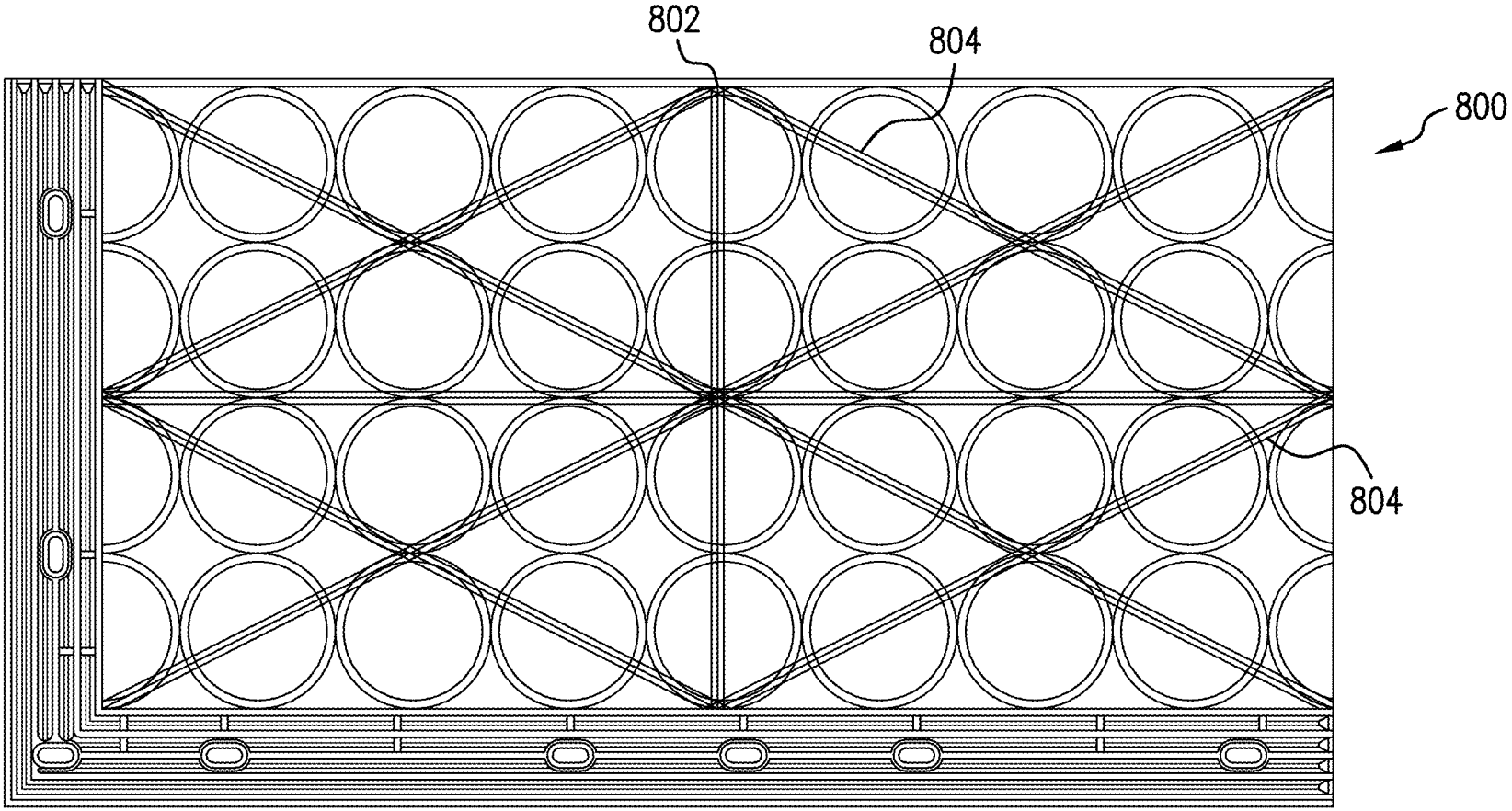
FIG. 8 is a schematic illustration of a mat in accordance with an embodiment of the present disclosure.
Figure 9:
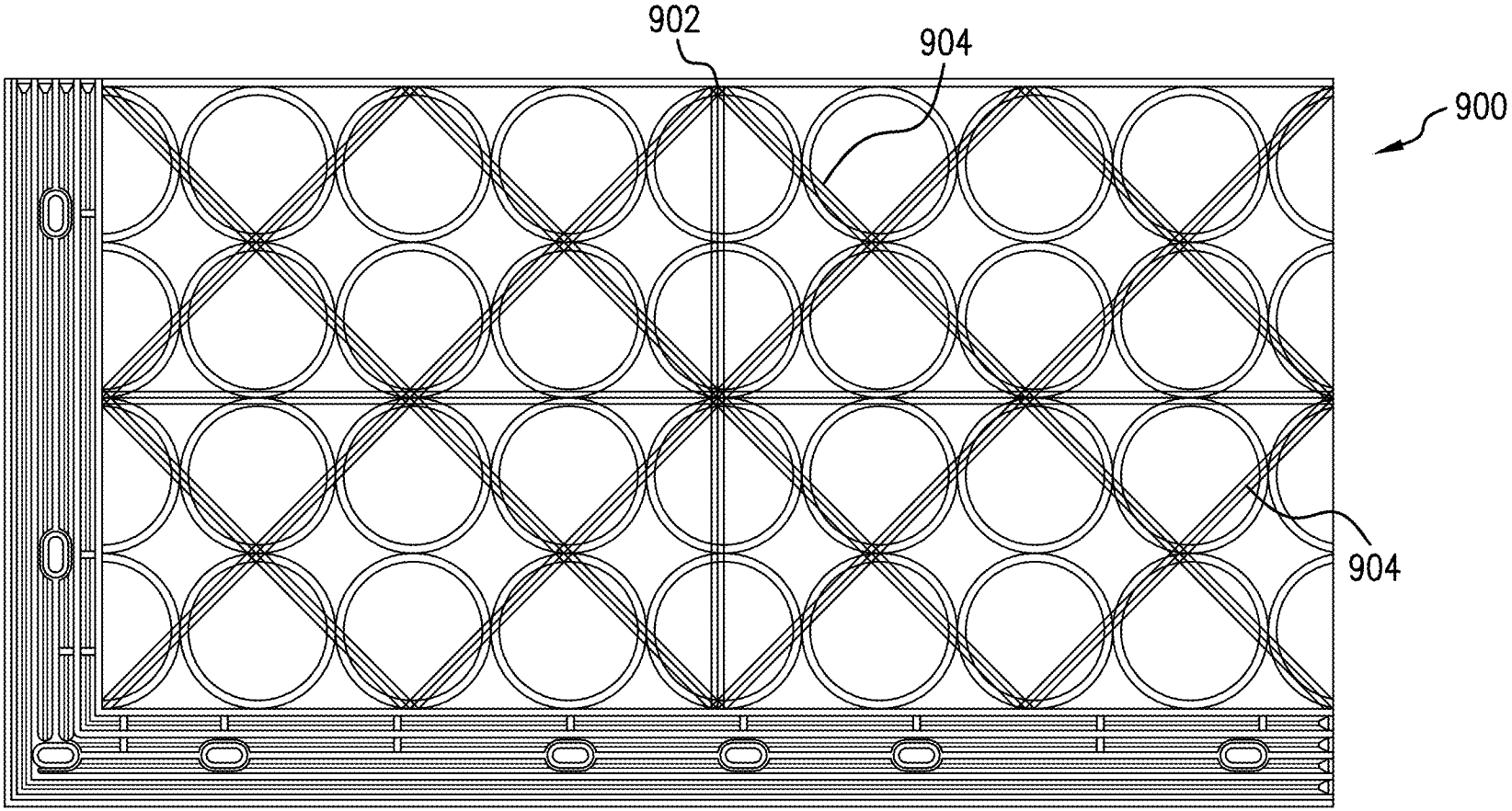
FIG. 9 is a schematic illustration of a mat in accordance with an embodiment of the present disclosure.

It will be appreciated that various alternative geometries of the sections and subsections that are formed within the main bodies of the mats may be achieved without departing from the scope of the present disclosure. Another example is shown in FIG. 8 illustrating a mat 800 having primary structural support ribs 802 and secondary structural support ribs 804 with the secondary structural support ribs 804 arranged in an X-shape within each section of the mat 800 defined by the primary structural support ribs 802. FIG. 9 illustrates a mat 900 having primary structural support ribs 902 and secondary structural support ribs 904 with the secondary structural support ribs 904 arranged in a double-X-shape within each section of the mat 900 defined by the primary structural support ribs 902. As illustrated, each mat 800, 900 of FIGS. 8-9 includes a pattern of internal walls that defines internal voids, similar to that shown and described above.

In view of the above and the associated illustrations, some embodiments of the present disclosure are directed to a tiered or multi-level configuration of support and structure within the main body of the mat. At the broadest or highest level, each mat has a main body that has internal structures. At the smallest level within the main body is a generally repeating pattern defined by a pattern of internal walls which define internal voids. The internal voids are spaces that contain no additional structure and are generally filled with air or gas. One step or tier higher are the subsections (if present) defined by the secondary structural support ribs. The subsections contain internal structure in the form of the pattern of internal walls. One step or tier higher than this are the sections defined by the primary structural support ribs. The sections contain internal structure in the form of the pattern of internal walls and the structural elements and features of the subsections (e.g., secondary structural support ribs), if present. It will be appreciated that in each of the above described embodiments of FIGS. 6-9, at least some of the secondary structural support ribs extend from a sidewall of the main body to a primary structural support rib.

As noted above, in some embodiments, the primary structural support ribs and the secondary structural support ribs may be substantially similar in material shape or dimension (e.g., material thickness). In other embodiments, the primary structural support ribs and the secondary structural support ribs may have different material dimensions. For example, in some embodiments, the primary structural support ribs may have a larger material thickness than the secondary structural support ribs. Alternatively, in some embodiments, the primary structural support ribs may have a smaller material thickness than the secondary structural support ribs. In some configurations, the length of the secondary structural support ribs is shorter than the longer length primary structural support ribs. In some such embodiments, the length of the secondary structural support ribs is shorter than the shorter length primary structural support ribs.

In some embodiments, some secondary structural support ribs may be configured to extend between two other secondary structural support ribs. Further, in some embodiments, some secondary structural support ribs may extend from one external sidewall of the main body to another external sidewall of the main body or may extend between two primary structural support ribs.

Advantageously, by incorporating the primary and, optional, secondary structural support ribs, the mats may be provided with additional rigidity and/or strength, as compared to mats without such features. The structural support ribs may provide increased crush resistance to the mat. Furthermore, because of the increased strength, rigidity, bending resistance, and crush resistance, the internal voids defined by the pattern of internal walls may be larger than a mat formed with just the pattern of internal walls, while maintaining comparable structural properties.

In addition to providing increased strength and structural properties to the mats, the structural support ribs can provide additional features. For example, because the structural support ribs are configured to sub-divide the main body into sections, it is possible to enable sub-dividing the entire mat into sub-mats or smaller mats obtainable by cutting up or physically dividing and separating a mat along one or more of the structural support ribs. The cutting may be performed using a saw, a knife, a blade, or other cutting tools and/or implements, as will be appreciated by those of skill in the art. Further, in some embodiments, a cutting line for dividing the mats may be visibly marked on the exterior surfaces of the mats, using dyes, lines, tracers, or other visible indicia. Alternatively, or in combination with visible indicia, the mats may and particularly the structural support ribs may include embedded features (e.g., magnetic material) that may provide for indication and guiding of cutting of the mats described herein.

Figure 10:
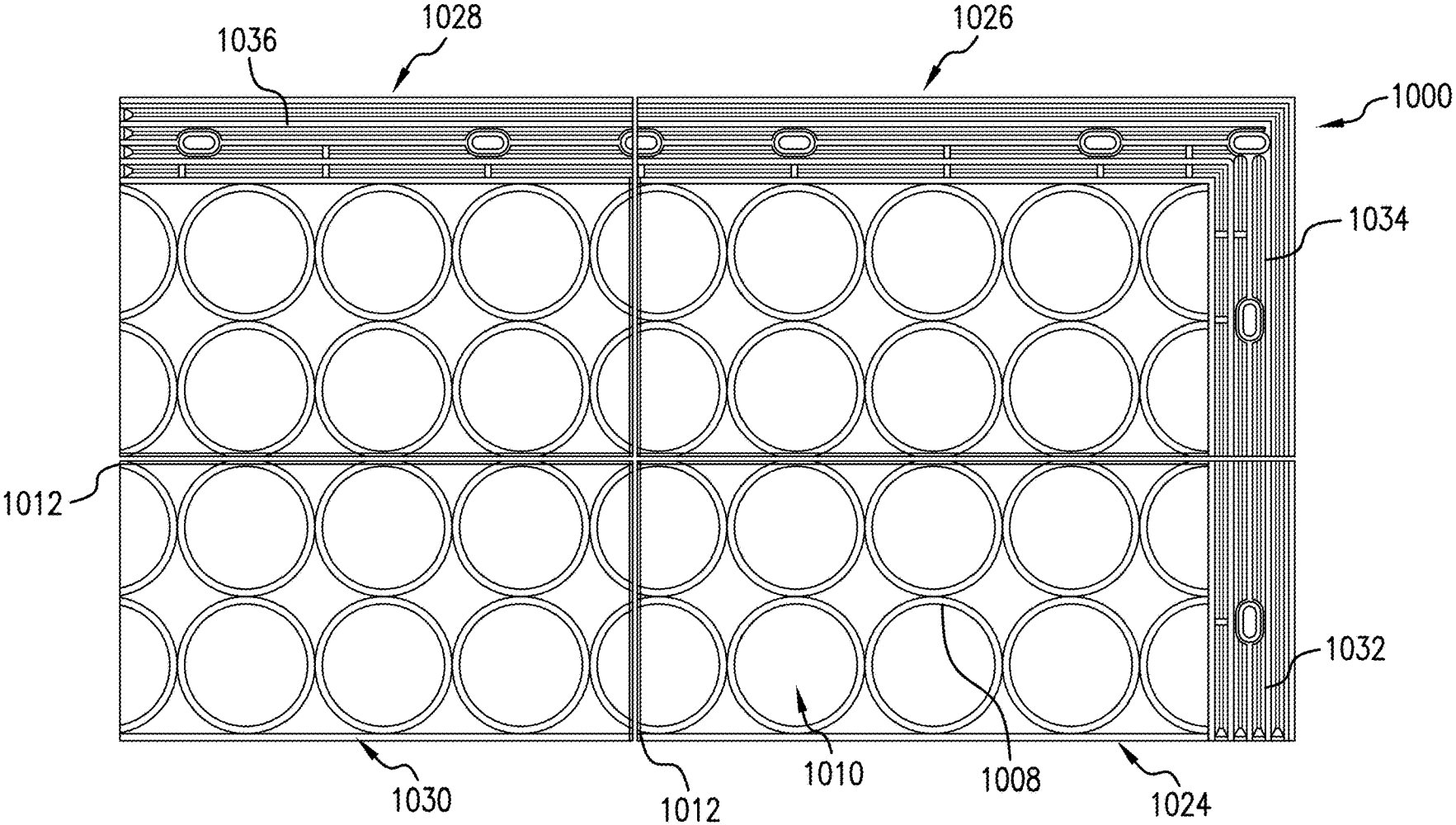
FIG. 10 is a schematic illustration of a mat in accordance with an embodiment of the present disclosure.

For example, turning to FIG. 10, a divided mat 1000 in accordance with an embodiment of the present disclosure is shown. The mat 1000 has a structure and arrangement similar to that shown and described in FIG. 5, with the mat 1000 having primary structural support ribs 1012 that traverse a pattern of internal walls 1008 and pass through internal voids 1010 defined by the pattern of internal walls 1008. The primary structural support ribs 1012 are configured to enable separation of portions of the mat 1000 to create sub-mats 1024, 1026, 1028, 1030. Each sub-mat 1024, 1026, 1028, 1030 includes one of the sections of the main body of the mat 1000. In this configuration and illustration, each sub-mat 1024, 1026, 1028, 1030 is of equal size and dimension with respect to the separation of the main body of the mat 1000. Advantageously, the primary structural support ribs 1012 permit the sub-mats 1024, 1026, 1028, 1030 to be separated and be fully encapsulated such that the sidewalls and edges do not permit external matter from entering an interior of the body of each of the sub-mats 1024, 1026, 1028, 1030.

The sub-mats 1024, 1026, 1028, 1030 are each individually configured to enable matching and connection with another mat or sub-mat. That is, each sub-mat 1024, 1026, 1028, 1030 includes a sub-portion of the main body, but also includes lip structures extending from one or more sidewalls thereof. In this illustration, a first sub-mat 1024 includes an associated lip structure 1032 along a section thereof. The first sub-mat 1024 also includes a section lip structure (not shown) that would be extending down from the first sub-mat 1024 on the page. A second sub-mat 1026 includes associated lip structure 1034, a third sub-mat 1028 includes a shown associated lip structure 1036 and also a lip structure that is not shown. A fourth sub-mat 1030 includes a lip structure that is not shown entirely. The associated lip structures are more clearly shown in embodiments later described.

To enable the separation of the sub-mats 1024, 1026, 1028, 1030, the primary structural support ribs 1012 may have a dual-rib structure. The dual-rib structure of the primary structural support ribs 1012 enables separation of the different sub-mats 1024, 1026, 1028, 1030 and have a part of the primary structural support ribs 1012 function as an exterior wall of the sub-mat. That is, once separated, the primary structural support ribs 1012 provide additional functionality by ensuring that the interior structure of the sub-mats 1024, 1026, 1028, 1030 remains encapsulated, sealed, and/or structurally sound to operate as a part of a support surface. The primary structural support ribs 1012 provide a continuous external surface about the body of the sub-mats 1024, 1026, 1028, 1030 that prevents material from invading or otherwise entering the interior of the respective sub-mat 1024, 1026, 1028, 1030. In some configurations, the primary structural support ribs 1012 may not have a dual-rib construction, but rather may be a solid material structure. In such configurations, the primary structural support ribs 1012 may have a material thickness sufficient to enable cutting through the material and form exterior walls of the formed sub-mats, similar to that shown and described.

Figure 11A:
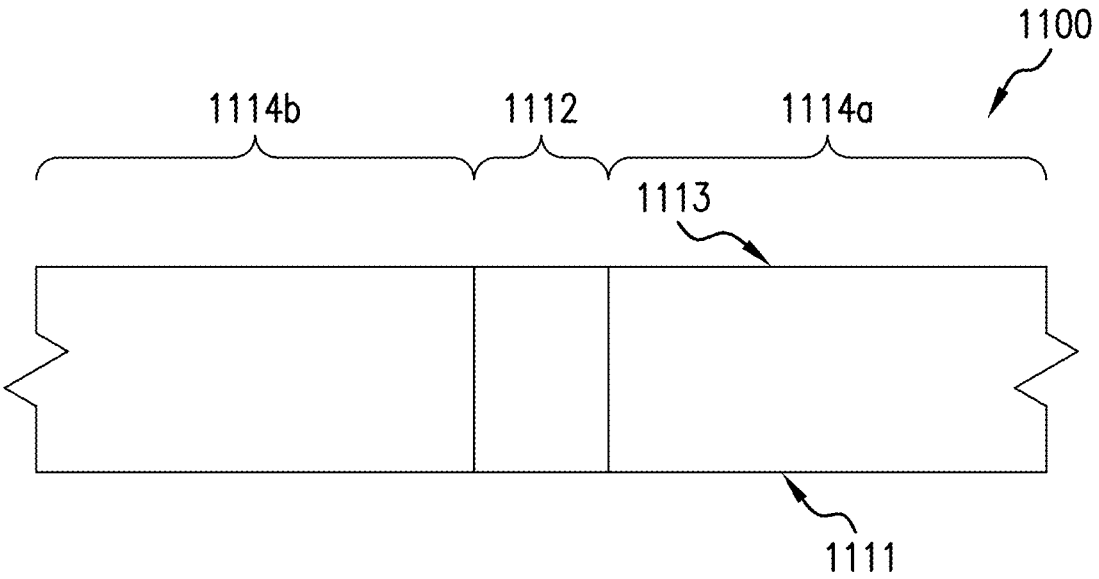
FIG. 11A is a schematic illustration of an aspect of a mat in accordance with an embodiment of the present disclosure.
Figure 11B:
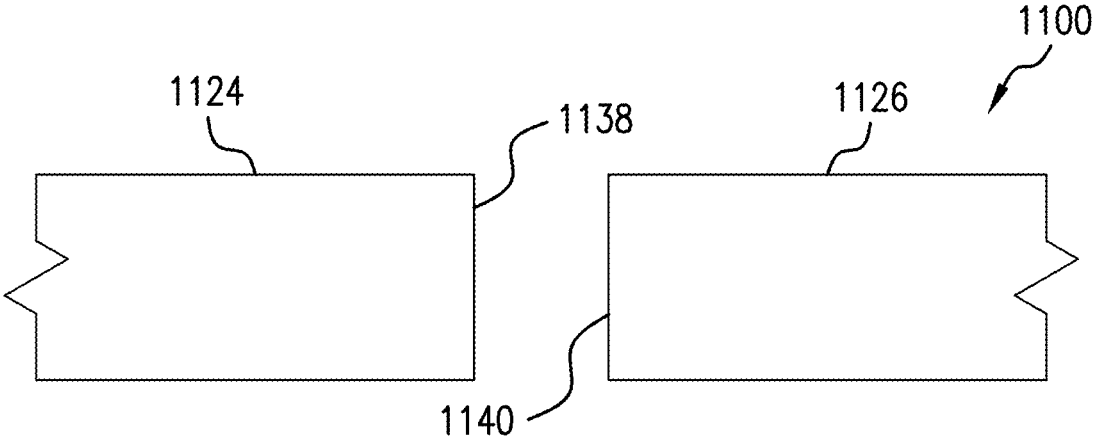
FIG. 11B is a schematic illustration of the mat of FIG. 11A, with parts of the mat separated in accordance with an embodiment of the present disclosure.

For example, turning to FIGS. 11A-11B, schematic illustrations of an enlarged view of a mat 1100 that has a similar configuration as that shown in FIG. 10 are shown. FIG. 11A illustrates the mat 1100 in an uncut state and FIG. 11B illustrates the mat 1100 in a cut state. In FIG. 11A, the mat 1100 has a primary structural support rib 1112 that separates a first section 1114*a* from a second section 1114*b*, as described above. In the uncut state, the mat 1100 has a first surface wall 1111 and a second surface wall 1113 that are parallel or substantially parallel walls of the mat 1100 and define, in part, a main body of the mat 1100. In FIG. 11B, the mat 1100 is separated and divided into sub-mats 1124, 1126. Further, the primary structural support rib 1112 shown in FIG. 11A has been separated and portions of the primary structural support rib 1112 now define external walls or surfaces of the sub-mats 1124, 1126. That is, as shown, the primary structural support rib 1112 becomes an exterior wall 1138 of the first sub-mat 1124 and an exterior wall 1140 of the second sub-mat 1126. The exterior walls 1138, 1140 provide for the resulting sub-mats 1124, 1126 to be sealed and properly protected from exterior environments after being separated. That is, the exterior walls 1138, 1126 maintain the protection of the interior secondary structural support ribs (if present) and an internal pattern of internal walls and defined internal voids.

The separation of the first sub-mat 1124 from the second sub-mat 1126 may be by any cutting tool, as known in the art. Further, although illustratively shown with the primary structural support rib 1112 having a hollow interior which separates into two separate and distinct exterior walls 1138, 1140, such configuration is not so limited. For example, the primary structural support rib may be a solid structure which is cut through to divide the mat into sub-mats. However, it will be appreciated that by having the primary structural support rib 1112 as a hollow structure, some weight savings may be achieved.

Figure 12A:
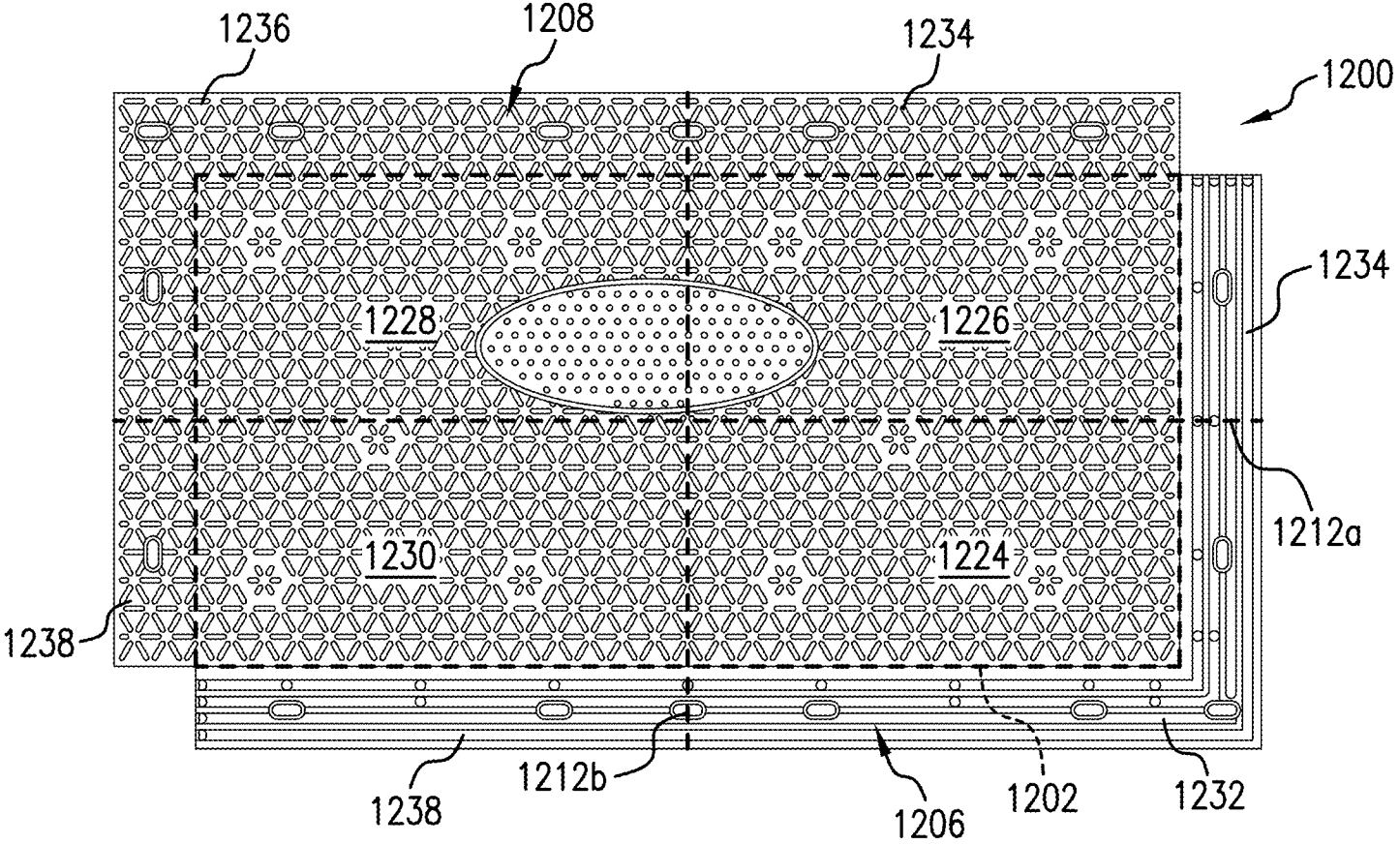
FIG. 12A is a schematic illustration of a mat in accordance with an embodiment of the present disclosure.

Turning now to FIG. 12A, a mat 1200 that may be subdivided into sub-mats 1224, 1226, 1228, 1230 in accordance with an embodiment of the present disclosure is shown. The mat 1200 comprises a main body 1200 that includes internal features and structures, as described above, including, at least, a pattern of internal walls defining internal voids and two primary structural support ribs 1212*a*, 1212*b* that separate the main body 1202 into four distinct sections, as shown and described above (e.g., as shown in FIG. 5). In some embodiments, each distinct section may include secondary structural support ribs, as shown and described above. Extending from the main body 1202 are a first lip structure 1206 and a second lip structure 1208, similar to that shown and described with respect to FIGS. 1-2.

The mat 1200 may be cut or otherwise separated into sub-mats 1224, 1226, 1228, 1230 by cutting along the primary structural support ribs 1212*a*, 1212*b*. This results in completely separate sub-mats 1224, 1226, 1228, 1230 which may be assembled with other sub-mats or complete (unseparated) mats to form a desired work or support surface. As shown, the first sub-mat 1224 includes a portion of the main body 1202 and includes a continuous lip structure 1232 around a portion of the body of the first sub-mat 1224, which is formed from a separated portion of the first lip structure 1206. The second sub-mat 1226 includes a portion of the main body 1202 and includes a discontinuous lip structure 1234, which is formed from a section of the first lip structure 1206 and a section of the second lip structure 1208. The third sub-mat 1228 includes a portion of the main body 1202 and includes a continuous lip structure 1236, which is formed entirely from a section of the second lip structure 1208. The fourth sub-mat 1230 includes a portion of the main body 1202 and includes a discontinuous lip structure 1238, which is formed from a section of the first lip structure 1206 and a section of the second lip structure 1208.

Figure 12B:
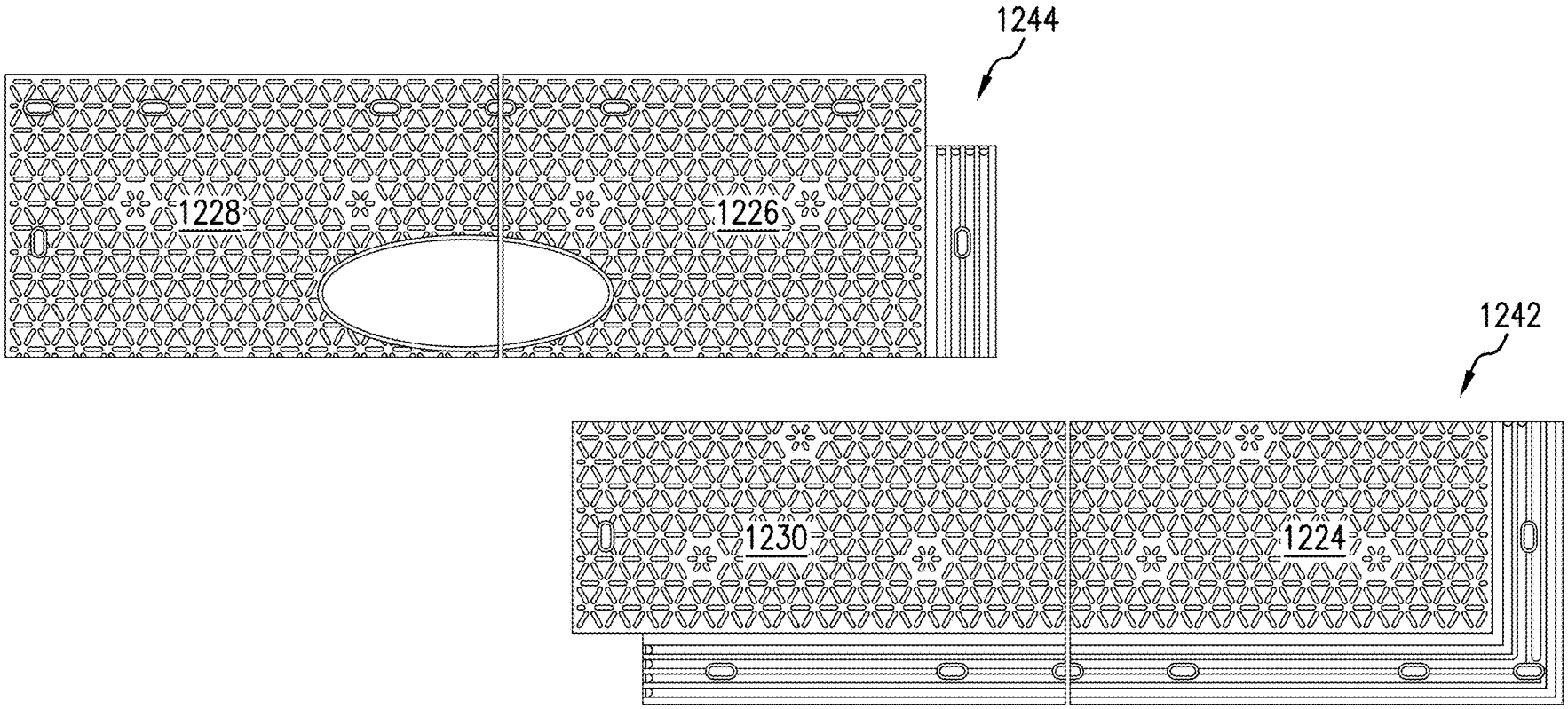
FIG. 12B is a schematic illustration of a separation of sub-mat assemblies from the mat of FIG. 12A in accordance with an embodiment of the present disclosure.
Figure 12C:
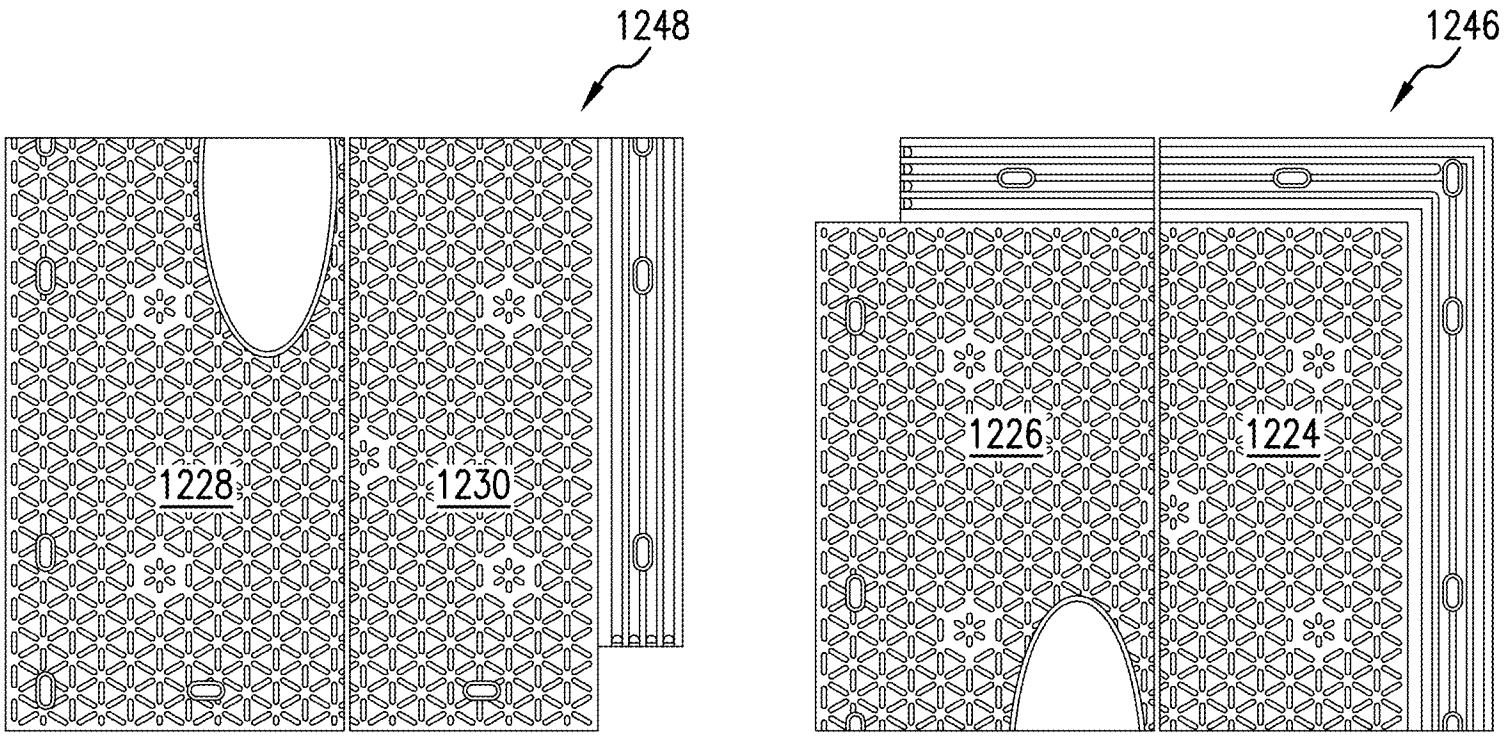
FIG. 12C is a schematic illustration of a separation of sub-mat assemblies from the mat of FIG. 12A in accordance with an embodiment of the present disclosure.
Figure 12D:
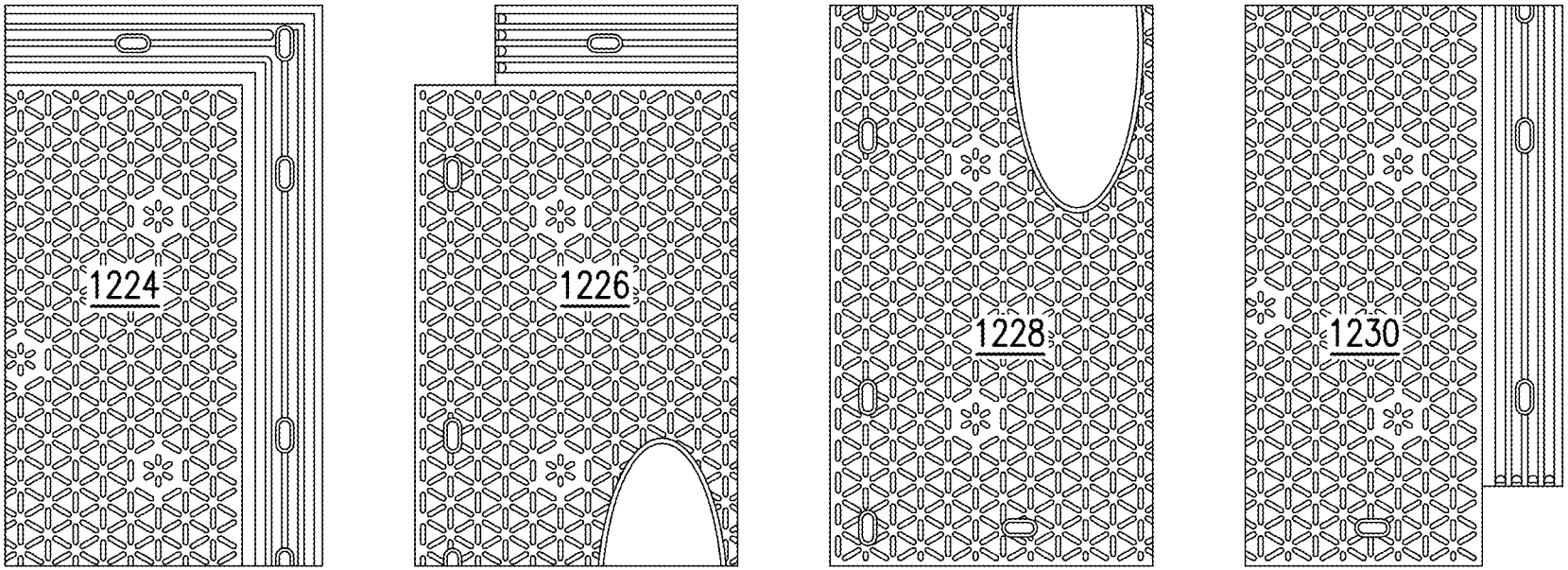
FIG. 12D is a schematic illustration of a separation of sub-mats from the mat of FIG. 12A.

The different configurations of the lip structures that extend from the bodies of the sub-mats 1224, 1226, 1228, 1230 enables different arrangements and orientations of the sub-mats. The first sub-mat 1224 and the third sub-mat 1228 are mirror images of each other and the second sub-mat 1226 and the fourth sub-mat 1230 are mirror images of each other. It will be appreciated that the mat 1200 does not need to be separated into four distinct portions, but rather could be cut in half along one of the two primary structural support ribs 1212*a*, 1212*b*, as shown in FIGS. 12B-12D. As shown, a first primary structural support rib 1212*a* extends in a direction generally perpendicular to a direction of a second primary structural support ribs 1212*b*.

FIG. 12B illustrates the mat 1200 as separated into two halves along the first primary structural support rib 1212*a*, with a first half formed of unseparated first and fourth sub-mats 1224, 1230 and a second half formed of unseparated second and third sub-mats 1226, 1228. As such, a first sub-mat assembly 1242 is formed of the first and fourth sub-mats 1224, 1230 and a second sub-mat assembly 1244 is formed of the second and third sub-mats 1226, 1228.

FIG. 12C illustrates the mat 1200 as separated into two halves along the second primary structural support rib 1212*b*, with a first half formed of unseparated first and second sub-mats 1224, 1226 and a second half formed of unseparated third and fourth sub-mats 1228, 1230. As such, a first sub-mat assembly 1246 is formed of the first and second sub-mats 1224, 1226 and a second sub-mat assembly 1248 is formed of the third and fourth sub-mats 1228, 1230.

FIG. 12D illustrates the mat 1200 as separated along both the first primary structural support rib 1212*a* and the second primary structural support rib 1212*b*, resulting in four separate sub-mats 1224, 1226, 1228, 1230.

It will be appreciated that a partial cut along each of the primary structural support ribs 1212*a*, 1212*b* can result in a substantially L-shape sub-mat assembly formed from three sub-mats and a separated single sub-mat.

The construction, illustration, and description made with respect to FIGS. 12A-12D are based on the specific orientation and arrangement of primary structural support ribs and the resulting sub-mats defined thereby. However, alternative arrangements or geometries may be possible without departing from the scope of the present disclosure. For example, a single mat could be sub-divided into six separate sub-mats that are substantially square with respect to the division of the main body of the mat. In each case, the resulting sub-mats or sub-mat assemblies are inclusively sealed and structurally sound to serve as a part of a support surface or structure (e.g., a roadway) either alone or combined with other mats, sub-mats assemblies, and/or sub-mats.

Figure 13:
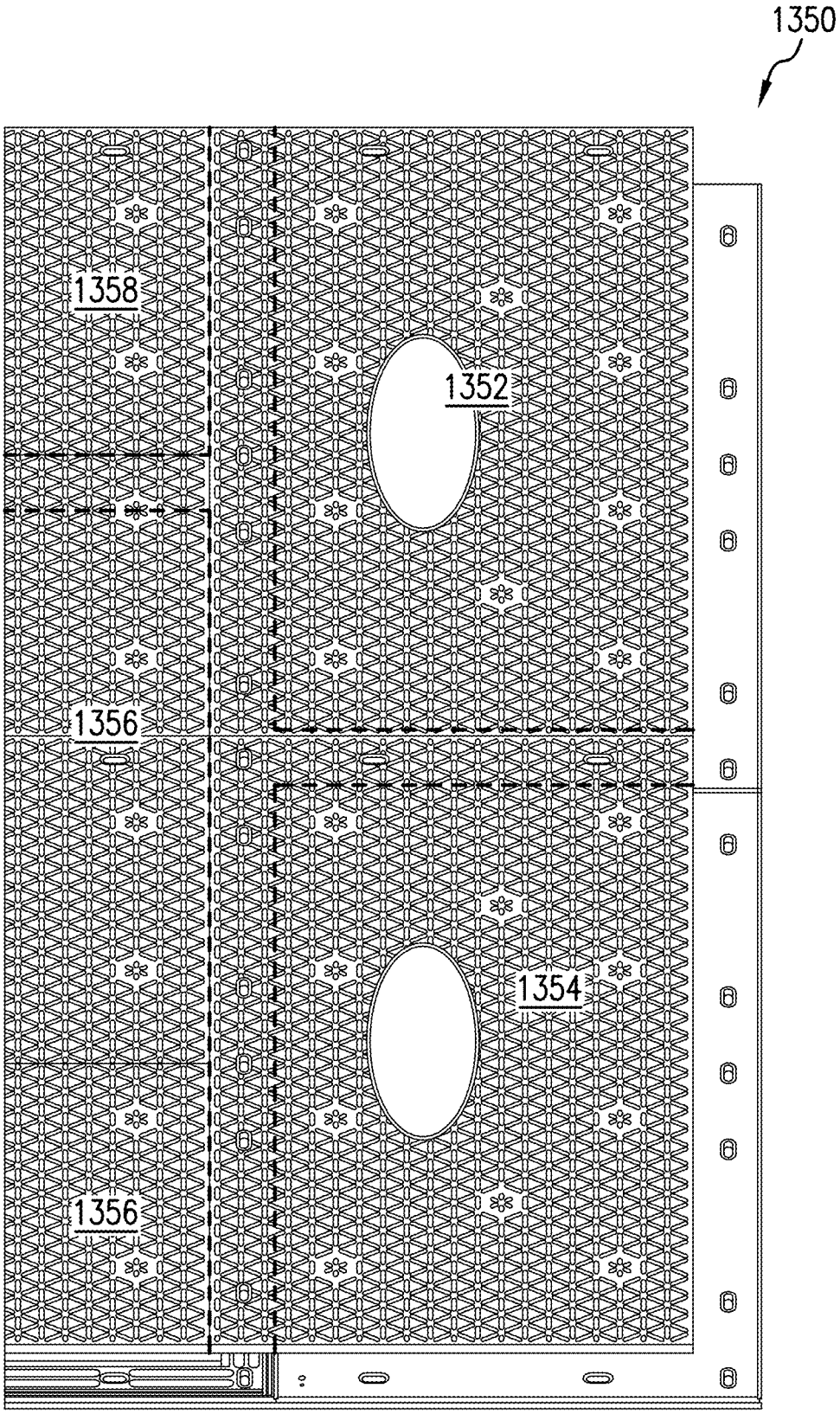
FIG. 13 is a schematic illustration of a mat assembly having mats, sub-mat assemblies, and sub-mats in accordance with an embodiment of the present disclosure.

Turning to FIG. 13, a schematic illustration of a mat assembly 1350 formed from a number of different mats/sub-mats is shown. In this illustrative configuration, two full mats 1352, 1354 are employed and assembled together using locking pins through pin apertures of overlapping lip structures. Two individual sub-mats 1356, 1358 are arranged along one side of the assembled full mats 1352, 1354 and connected by overlapping lip structures. Between the two individual sub-mats 1356, 1358 is a sub-mat assembly 1356 which is formed of two non-separated sub-mats. In FIG. 13, the dashed lines indicate that portions of overlap of lip structures.

Figure 14A:
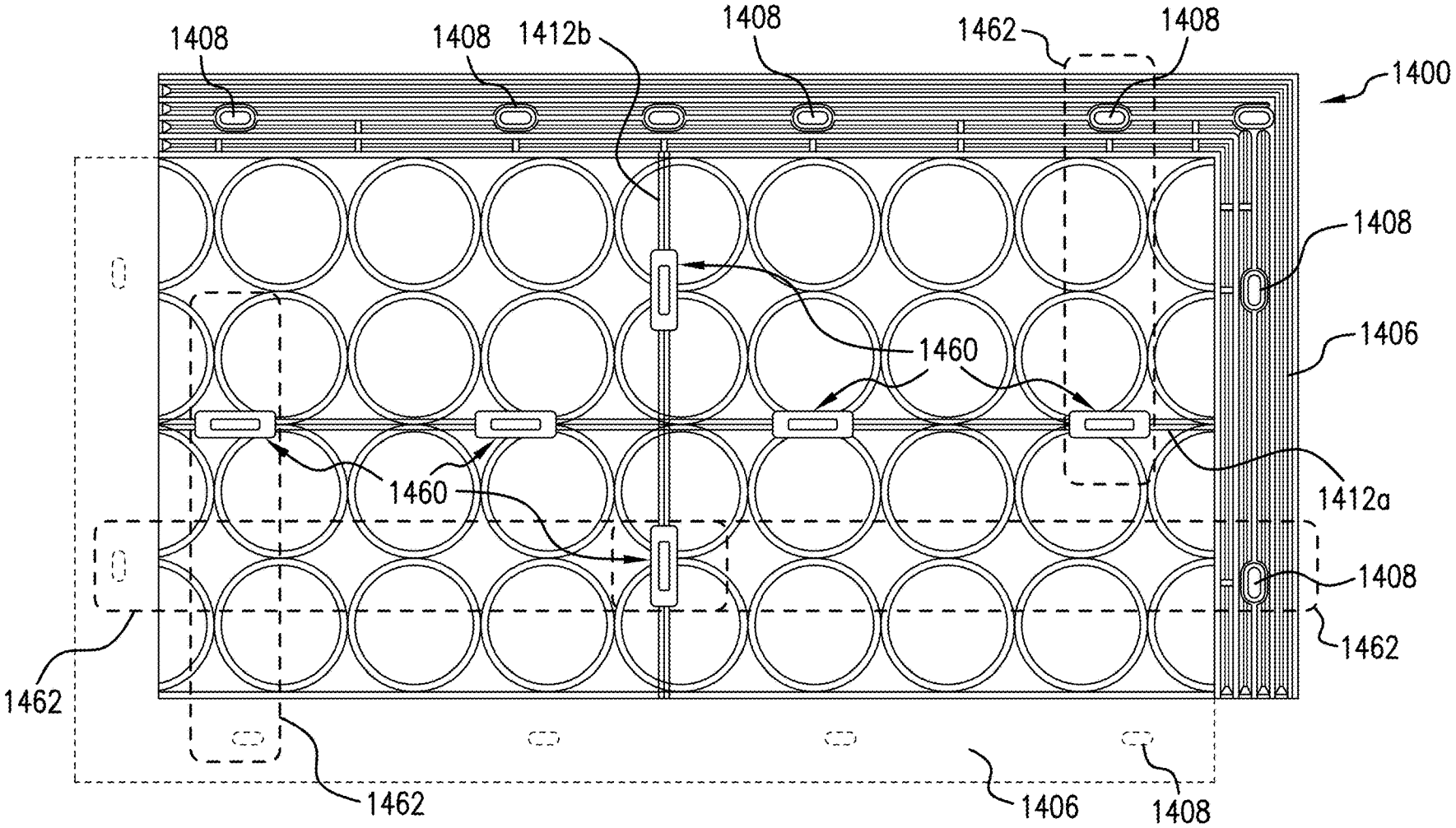
FIG. 14A is a schematic illustration of a mat in accordance with an embodiment of the present disclosure.
Figure 14B:
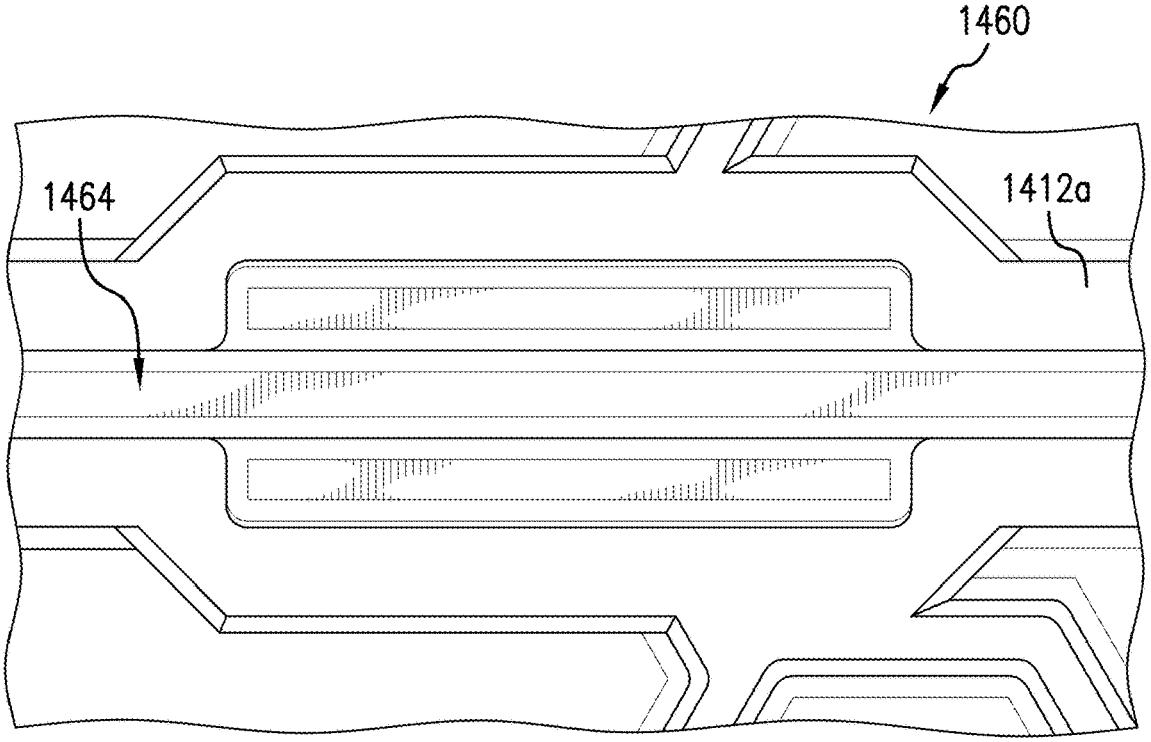
FIG. 14B is an enlarged illustration of a feature of the mat of FIG. 14A.
Figure 14C:
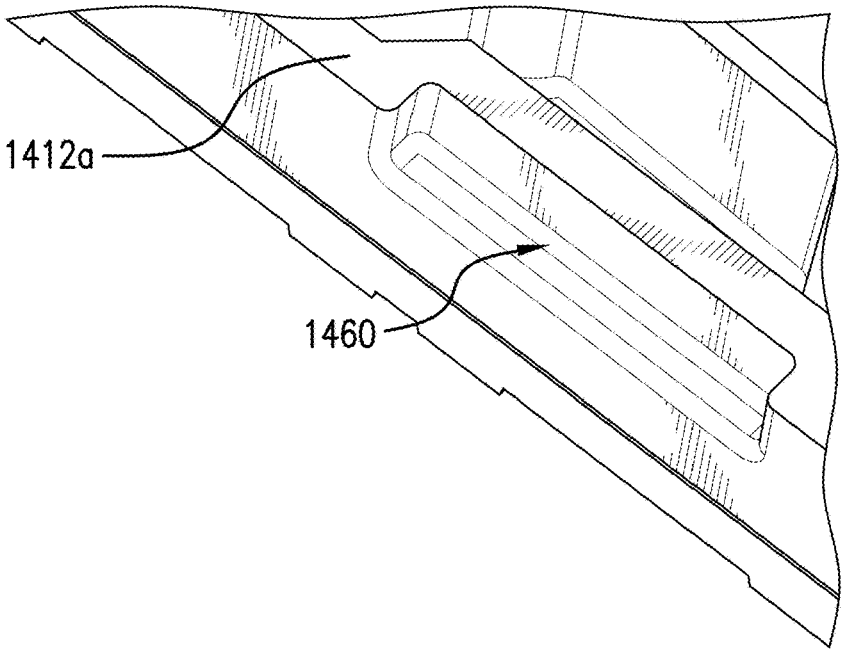
FIG. 14C is an alternative enlarged illustration of the feature of the mat of FIG. 14A.

Turning now to FIGS. 14A-14C illustrate a mat 1400 and aspects thereof. The mat 1400 is similar to that shown and described above, and thus various aspects will not be described again. The mat 1400 includes a main body a having lip structures 1406 extending therefrom, as described above. The mat 1400 further includes primary structural support ribs 1412*a*, 1412*b* that provide for additional structural support and enable separation of the mat 1400 into sub-mats and/or sub-mat assemblies, as shown and described above. FIG. 14A is a plan view illustration of the interior structure of the mat 1400 that includes hook pockets 1460 arranged at locations along the primary structural support ribs 1412*a*, 1412*b*. The hook pockets 1460 are arranged at locations along the respective primary structural support ribs 1412*a*, 1412*b* at locations opposite or aligned with pin apertures 1408 in the lip structures 1406.

If the mat 1400 is in the complete or unseparated configuration, the mat 1400 may be manipulated or moved around by a tool that engages with the pin apertures 1408 on opposite sides of the mat 1400. However, if the mat 1400 is divided up, as described above, it may be difficult to lift, move, and otherwise maneuver the sub-mats or sub-mat assemblies that are created by dividing up the mat 1400. The hook pockets 1460 become exposed when the mat 1400 is cut along the primary structural support rib(s) 1412*a*, 1412*b*, thus allowing for a tool to engage with the sub-mat or sub-mat assembly and enable movement, positioning, and other manipulation of the sub-mat or sub-mat assembly. The hook pockets 1460 are gaps or voids in the body that are configured, such as sized and shaped, for gripping by an individual or a tool to move or manipulate the mat. If the mat 1400 is cut or otherwise separated as described above, the hook pockets 1460 can be exposed on each of the sub-mats. The hook pockets 1460 can be sized and shaped to receive a grapple device to lift or move the sub-mats of the mat 1400. For example, as shown, each hook pocket 1460 may be aligned with one or more pin apertures 1408 of the lip structures 1406 and form hook pairs 1462 such that a tool can engage on opposing sides/ends of the formed sub-mats or sub-mat assemblies.

FIGS. 14B-14C illustrated more enlarged and detailed illustrations of a hook pocket 1460 in accordance with an embodiment of the present disclosure. As noted, the hook pocket 1460 is arranged along, and is part of, the primary structural support ribs 1412*a*. The hook pockets 1460 are pockets arranged along the primary structural support ribs 1412*a*, and define an enlarged cavity or space along a channel 1464 of the primary structural support ribs 1412*a*. After a sub-mat or sub-mat assembly is cut from the full mat 1400, the walls or structure of the primary structural support ribs 1412*a* and the hook pockets 1460 are exposed. It is noted that this structure (channel 1464 and hook pocket 1460) is not exposed to the elements until the mat 1400 is cut or otherwise divided/subdivided into sub-mats and/or sub-mat assemblies.

Advantageously, embodiments of the present disclosure are directed to improved mats and mat systems for providing and creating temporary roadways and/or support surfaces. The mats of the present disclosure have increased capabilities through the inclusion of structural support ribs arranged within a main body of the mats, which overlays a pattern of internal walls and defined internal voids. As such, the mats may be improved by reduced weight (achieved through inclusion of the internal voids) while maintaining high bend and crush resistance. It is noted that although a bend resistance is provided, the mats are able to bend or flex under weight such that they are not brittle and inflexible. However, the bend resistance provided by the structures of the present disclosure (both primary and secondary structural support ribs) prevents the mat from completely buckling when weight or forces is applied thereto. That is, embodiments of the present disclosure enable the formation of mats and mat systems that have reduced weight, with desired crush resistance and desired flexibility.

Advantageously, embodiments of the present disclosure provide for modular mat systems that allow for a single mat to be divided or sub-divided into sub-mats and sub-mat assemblies that allow for customization of size, shape, and dimensions of a formed temporary roadways and/or support surfaces catered to a specific application. That is, the amount of area covered by the mats and mat systems of the present disclosure is significantly more customizable than prior systems that were not sub-dividable. Further, such sub-dividable mats may include features to allow for ease of manipulation and moving such mats after a mat is subdivided into sub-mats or sub-mat assemblies. The sub-mats and sub-mat assemblies are configured to be sealed such that the interior structure of the bodies of the mats are not exposed after being separated, thus preventing debris or moisture from entering the interior of the mats and causing issues therewith.

As used herein, the terms "about" and "substantially" are intended to include the degree of error associated with measurement of the particular quantity based upon the equipment available at the time of filing the application. For example, "about" may include a range of ±8%, or 5%, or 2% of a given value or other percentage change as will be appreciated by those of skill in the art for the particular measurement and/or dimensions referred to herein.

The terminology used herein is for the purpose of describing particular embodiments only and is not intended to be limiting of the present disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an illustrative embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A mat comprising:

a main body defined by a plurality of sidewalls and two exterior surface walls opposing each other, wherein the main body includes a pattern of internal walls that define internal voids within the main body;

at least one primary structural support rib arranged within the main body and extending between the two exterior surface walls to a second of the two exterior surface walls and from a midpoint between ends of one of the plurality of side walls to a midpoint between ends of another of the plurality of side walls, wherein the at least one primary structural support rib traverses a first plurality of the internal voids defined by the pattern of internal walls, wherein the at least one primary structural support rib divides the main body into at least two sections; and at least two secondary structural support ribs arranged within each of the at least two sections defined by the at least one primary structural support rib, wherein each secondary structure support rib extends between the two exterior surface walls, wherein each secondary structural support rib traverses a second plurality of the internal voids defined by the pattern of internal walls, wherein each secondary structural support rib is arranged at an angle that is non-perpendicular relative the at least one primary structural support rib, and wherein the at least one primary structural support rib is configured to enable separation of the mat into a plurality of sub-mats along a channel defined by the at least one primary structural support rib.

2. The mat of claim 1, wherein the walls of the pattern of internal walls extend between the two exterior surface walls.

3. The mat of claim 1, wherein the at least two secondary structural support ribs are arranged in an X-shape within a respective section defined by the at least one primary structural support rib.

4. The mat of claim 1, wherein the at least two secondary structural support ribs divide the respective section into three or more subsections.

5. The mat of claim 1, wherein at least one secondary structural support rib of the secondary structural support ribs extends from at least one of the side walls to the at least structural support rib.

6. The mat of claim 1, wherein each secondary structural support rib has a length that is less than a length of the at least one primary structural support rib.

7. The mat of claim 1, wherein each secondary structural support rib has a material thickness that is less than a material thickness of the at least one primary structural support rib.

8. The mat of claim 1, wherein each sub-mat that is configured to be separated from the mat is configured to secure or connect to another one of the plurality of the sub-mats that is configured to be separated from the mat or another mat.

9. The mat of claim 1, further comprising a hook pocket defined along the channel of the at least one primary structural support rib, the hook pocket configured to enable a tool to engage with a sub-mat.

10. The mat of claim 1, further comprising a lip structure extending outwardly from the plurality of sidewalls around a periphery of the main body.

11. The mat of claim 10, wherein the at least one primary structural support rib is configured to enable separation of the mat into a plurality of sub-mats along a channel defined by the at least one primary structural support rib and wherein each sub-mat includes a portion of the lip structure.

12. The mat of claim 1, wherein the internal voids of the interior support structure define at least 45% of an interior volume of the main body.

13. The mat of claim 1, wherein:

the plurality of sidewalls comprise a first sidewall, a second sidewall, a third sidewall, and a fourth sidewall, the first sidewall and the third sidewall are opposite each other, the second sidewall and the fourth sidewall are opposite each other, the first and third sidewalls are arranged normal to the second and fourth sidewalls, and wherein the at least one primary structural support rib comprises:

a first primary structural support rib that extends between the first sidewall and the third sidewall; and a second primary structural support rib that extends between the second sidewall and the fourth sidewall.

14. A mat comprising:

a main body defined by a plurality of sidewalls and two exterior surface walls opposing each other, wherein the main body includes a pattern of internal walls that define internal voids within the main body; and at least one primary structural support rib arranged within the main body and extending from a first of the two exterior surface walls to a second of the two exterior walls and from one of the plurality of side walls to another of the plurality of side walls, wherein the at least one primary structural support rib traverses the internal voids defined by the pattern of internal walls, wherein the at least one primary structural support rib comprises two rib walls with a channel defined between the two rib walls, wherein at least one primary structural support rib is configured to enable separation of the mat into a plurality of sub-mats along the channel defined by the at least one primary structural support rib, and wherein each sub-mat that is configured to be separated from the mat is different from each other sub-mat separated from the mat and is configured to secure or connect to another one of the plurality of the sub-mats or another mat.

15. The mat of claim 14, wherein the at least one primary structural support rib divides the main body into at least two sections, the mat further comprising:

at least one secondary structural support rib arranged within each of the at least two sections defined by the at least one primary structural support rib, wherein the at least one secondary structural support rib traverses the internal voids defined by the pattern of internal walls, wherein the at least one secondary structural support rib divides a respective section into two or more subsections.

16. The mat of claim 14, further comprising at least one secondary structural support rib that extends from at least one of the side walls to at least one of the at least one primary structural support rib.

17. The mat of claim 14, further comprising at least one secondary structural support rib, the at least one secondary structural support rib having at least one of (i) a material thickness that is less than a material thickness of the at least one primary structural support rib and (ii) a length that is less than a length of the at least one primary structural support rib.

18. The mat of claim 14, further comprising a hook pocket defined along the channel of the at least one primary structural support rib, the hook pocket configured to enable a tool to engage with a sub-mat.

19. The mat of claim 14, further comprising a lip structure extending outwardly from the plurality of sidewalls around a periphery of the main body, wherein the at least one primary structural support rib is configured to enable separation of the mat into the plurality of sub-mats along the channel defined by the at least one primary structural support rib and wherein each sub-mat includes a portion of the lip structure.

20. A mat comprising:

a main body defined by a plurality of sidewalls and two exterior surface walls opposing each other, wherein the main body includes a pattern of internal walls that define internal voids within the main body;

at least one primary structural support rib arranged within the main body and extending between the two exterior surface walls to a second of the two exterior walls and from a midpoint between ends of one of the plurality of side walls to a midpoint between ends of another of the plurality of side walls, wherein the at least one primary structural support rib traverses a first plurality of the internal voids defined by the pattern of internal walls, wherein the at least one primary structural support rib divides the main body into at least two sections;

at least two secondary structural support ribs arranged within each of the at least two sections defined by the at least one primary structural support rib, wherein each secondary structure support rib extends between the two exterior surface walls, wherein each secondary structural support rib traverses a second plurality of the internal voids defined by the pattern of internal walls; and a lip structure extending outwardly from the plurality of sidewalls around a periphery of the main body, wherein each secondary structural support rib is arranged at an angle that is non-perpendicular relative the at least one primary structural support rib, and wherein the at least one primary structural support rib is configured to enable separation of the mat into a plurality of sub-mats along a channel defined by the at least one primary structural support rib and wherein each sub-mat includes a portion of the lip structure.

* * * * *